US008550565B2

(12) United States Patent
Caldwell

(10) Patent No.: US 8,550,565 B2
(45) Date of Patent: Oct. 8, 2013

(54) WEB-STRAPPED FURNITURE, WEB-STRAPPING FOR FURNITURE, AND METHODS FOR WEB-STRAPPING FURNITURE

(76) Inventor: John W. Caldwell, San Marino, CA (US)

( * ) Notice: Subject to any disclaimer, the term of this patent is extended or adjusted under 35 U.S.C. 154(b) by 0 days.

(21) Appl. No.: 13/296,671

(22) Filed: Nov. 15, 2011

(65) Prior Publication Data

US 2013/0062924 A1 Mar. 14, 2013

Related U.S. Application Data

(60) Provisional application No. 61/533,686, filed on Sep. 12, 2011.

(51) Int. Cl.
*A47C 7/22* (2006.01)
*A47C 7/02* (2006.01)

(52) U.S. Cl.
USPC ..... 297/452.63; 160/398; 160/392

(58) Field of Classification Search
USPC ..... 411/507, 506; 24/265 C; 160/398, 160/403, 404, 392; 297/452.63
See application file for complete search history.

(56) References Cited

U.S. PATENT DOCUMENTS

| | | | | |
|---|---|---|---|---|
| 1,469,977 | A * | 10/1923 | Weaver | 411/503 |
| 2,457,343 | A * | 12/1948 | Braunschweiger | 160/371 |
| 2,586,262 | A * | 2/1952 | Robins | 5/120 |
| 2,979,119 | A * | 4/1961 | Hyman | 160/385 |
| 3,114,578 | A | 12/1963 | Hamilton | |
| 3,125,156 | A * | 3/1964 | Grimshaw | 160/382 |
| 3,137,372 | A * | 6/1964 | Nash | 403/206 |
| 4,359,809 | A * | 11/1982 | Fraser | 24/265 C |
| 4,926,605 | A * | 5/1990 | Milliken et al. | 52/63 |
| 5,445,436 | A | 8/1995 | Kemnitz | |
| 5,497,537 | A * | 3/1996 | Robinson et al. | 24/716 |
| 5,769,500 | A * | 6/1998 | Holbrook | 297/463.2 |
| 5,826,312 | A * | 10/1998 | Schroder et al. | 24/601.2 |
| 6,560,827 | B1 * | 5/2003 | Gross | 24/265 C |
| 7,568,768 | B1 * | 8/2009 | Tsai | 297/452.63 |

OTHER PUBLICATIONS

"Upholstery Supplies—Pirelli Rubber Webbing—2" wide;" http://www.perfectproductsonline.com/rubberwebbing/html; bears copyright date of 2003; printed Sep. 9, 2011; 2 pages.

* cited by examiner

*Primary Examiner* — David Dunn
*Assistant Examiner* — Tania Abraham
(74) *Attorney, Agent, or Firm* — Khorsandi Patent Law Group, A Law Corporation; Marilyn R. Khorsandi

(57) ABSTRACT

Exemplary embodiments of the present invention would provide web-strapping for upholstery of furniture, methods of providing web-strapping for upholstery of furniture, web-strapped furniture, and methods of web-strapping furniture. One exemplary embodiment of the present invention would provide an exemplary strap assembly of material for furniture upholstery comprising at least one fastener fastened into each end of the strap such that a tail end of each fastener is secured from extraction from the strap. In one exemplary strap assembly embodiment, fasteners would be fastened in each corner of each end of a strap so that a tail end of each fastener would be secured from extraction from the strap. Other exemplary embodiments would provide an exemplary article of furniture and methods of making an exemplary article of furniture, comprising said strap assemblies installed to span a space between opposing chair rails.

17 Claims, 21 Drawing Sheets

(Holbrook, Fig.2)

(Holbrook, Fig.3)

FIG. 5A
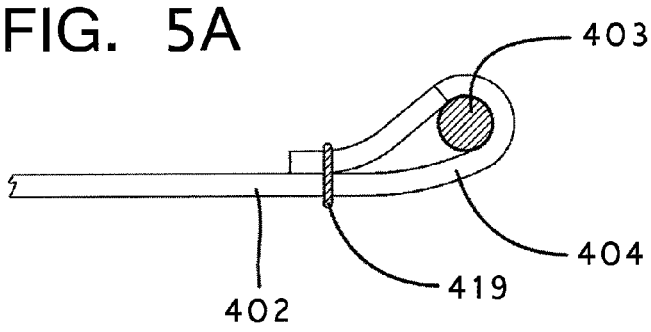
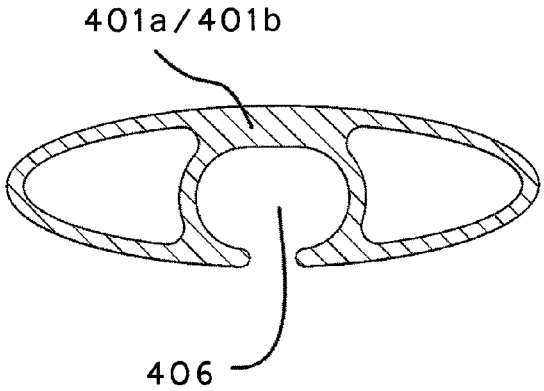
FIG. 5B
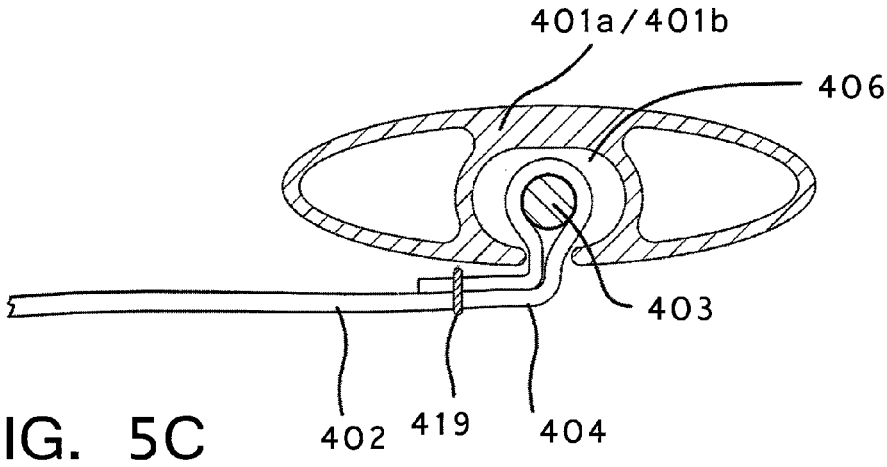
FIG. 5C

WEB-STRAPPED FURNITURE, WEB-STRAPPING FOR FURNITURE, AND METHODS FOR WEB-STRAPPING FURNITURE

CROSS-REFERENCE TO RELATED APPLICATIONS

This application claims priority to U.S. Provisional Application Ser. No. 61/533,686, filed. Sep. 12, 2011, entitled "WEB-STRAPPED FURNITURE, WEB-STRAPPING FOR FURNITURE, AND METHODS FOR WEB-STRAPPING FURNITURE," the entire content and disclosures of which are incorporated for all purposes by reference herein as is fully stated herein.

FIELD OF THE INVENTION

The field of the present invention is web-strapped furniture, web-strapping for furniture, and methods for web-strapping furniture.

BACKGROUND OF THE INVENTION

Furniture for indoor and/or outdoor use, such as casual furniture, may comprise a metal frame with a seat and/or back formed from straps that are attached or otherwise secured to the metal frame.

Frames for such chairs may be made of tubular material such as tubular metal, or may be formed of material such as metal with slots in the frames into which straps may be secured.

Straps for such furniture may be made of vinyl or other materials.

There have been various ways for attaching straps to such frames. Some ways to attach straps to metal frames are disclosed, for example, in U.S. Pat. Nos. 3,114,578 (E. F. Hamilton; "Hamilton") and 5,445,436 (Glen D. Kemnitz; "Kemnitz"). FIG. 8 of Kenmitz depicts a Kemnitz tabbed end (element number 48 of FIG. 8 of Kenmitz) of a strap (element number 16 of FIG. 8 of Kenmitz) that could be inserted through a slot (element number 80 of FIG. 8 of Kenmitz) of a frame such that the tab (element number 52 of FIG. 8 of Kenmitz) catches and abuts itself against an inner wall (element number 82 of FIG. 8 of Kenmitz) of the chair frame to anchor the end of the strap in the frame. Kenmitz discloses that the strap would then be stretched and wrapped around the frame so that the opposing end of the strap could be similarly fastened to the opposing side of the Kenmitz frame.

FIG. 11 of Kenmitz depicts one of various "external" ways of securing an end of a strap to a frame. As depicted in FIG. 11 of Kenmitz, a fastener, such as a canoe clip (element number 184 of FIG. 11 of Kenmitz), a screw, a Christmas tree clip, or similar fastener, may be used to pierce an end of a strap (element number 172 of FIG. 11 of Kenmitz) and the tubular frame (element number 80' of FIG. 11 of Kenmitz) to which the strap is to be attached. Similar to the above-described Kenmitz tabbed-end method of securing a strap to a frame, FIG. 11 of Kenmitz shows a Kenmitz strap (element number 16' of FIG. 11 of Kenmitz) being wrapped around the tubular frame. As will be understood by someone with ordinary skill in the art, the wrapping of a strap may involve heating the strap to form a close conformance of the strap to the frame and to allow stretching of the strap so that the opposing end can be similarly anchored; cooling of the strap results in the strap condensing in form thereby forming a close fit to the frame.

A way of securing straps to wooden frames has been provided by a manufacturer known as "PIRELLI"—PIRELLI has provided rubber webbing straps and webbing "clips", an exemplary illustration of which is depicted in FIGS. 1-3 hereto. As depicted in FIG. 1 hereto, an exemplary PIRELLI clip 190 comprises a piece of metal with "spurs" or "barbs" 192 that, when the clip is compressed so that one side meets the opposing side, the "spurs" or "barbs" fit into small holes 191 or indentations in the opposing side. As will be understood by someone with ordinary skill in the art, a PIRELLI clip could be fit and compressed over an end 194 of a strap 193, such as a rubber strap, such as illustratively depicted in FIG. 2, so that the PIRELLI clip "spurs" would pierce or anchor the material 195 in the opposing small holes 191 of the clip 190; the end of the PIRELLI clip 190 could then be inserted into a wooden frame slot 196 as depicted in FIG. 3; the opposing end of a rubber strap could be similarly capped with a PIRELLI clip and inserted in a wooden frame slot on an opposing frame element (not shown).

As will be understood by someone with ordinary skill in the art, PIRELLI clips have been used with wooden furniture and with rubber straps. As will be understood by someone with ordinary skill in the art, because of the thickness of vinyl straps, PIRELLI clips would not tend to pierce or anchor vinyl material in opposing PIRELLI holes and would therefore not provide a secure anchor. Further, as depicted in FIGS. 1-3 hereto, the shape of PIRELLI clips would not tend to prevent extraction of a PIRELLI-clipped end of a strap from a channel in a tubular metal frame such as illustratively depicted in, for example, FIG. 5B-C, 6A-D, 13, 14A-B, or 15-18 hereto.

An alternative way of providing strapping for chairs is disclosed in U.S. Pat. No. 5,769,500 (Richard Holbrook; "Holbrook"). Holbrook discloses segments with injection-molded portions on each end of the segment that fit into channels formed in opposing rails of a metal frame. As will be understood by someone with ordinary skill in the art, equipment for injection-molding segments such as disclosed in Holbrook are very expensive, some costing in the range of $100,000. Further, as will be understood by someone with ordinary skill in the art, due to costs involved in injection-molding processes, orders for injection-molded segments as disclosed by Holbrook may involve molding thousands of segments of a single configuration, size and color; small orders or individual orders for a single segment would not be commercially practical. Further, as will be understood by someone with ordinary skill in the art, injection-molded Holbrook segments would be relatively hard and would not easily mold around a frame in which rail channels are disposed in exterior sides of rails or in the back of rails. Rather, FIGS. 2 and 3 of Holbrook disclose Holbrook segments fitting into a "top" or "front" channel of a metal frame; such applications of Holbrook segments do not involve bending a Holbrook segment around a frame rail such as is depicted in, for example, FIGS. 14A-B, 15 and 16 hereto.

As an alternative to chairs with strapping, casual furniture may comprise a "sling" that forms a back and a seat comprising a singular "sling" member. For example, as depicted in FIG. 4 hereto, a singular "sling" member 402 is secured to a metal frame to form a chair back and seat. Such "sling" chairs may comprise a metal frame with opposing members, e.g., frame side rails 401*a* and 401*b* wherein each opposing member (each frame side rail) comprises a channel (see element number 406, FIGS. 5B and 5C) that traverses the length of the member (e.g., elements 401*a* and 401*b*). An exemplary "sling" may comprise a single piece of material 402, such as vinyl mesh material; each side 404 of the single piece of material 402 may be wrapped around a corresponding cord member 403 (sometimes referred to as a "keeper rod") as depicted in FIG. 5A; stitching 419 may be used to fasten the material 402 around the cord ("keeper rod"); each cord-wrapped side is inserted through a corresponding channel 406 in the corresponding frame member 401*a*/401*b* as depicted, e.g., in FIG. 5C.

Sling chairs and sling members may be very expensive. In commercial environments such as large hotels, when a sling member of such chairs is damaged, it may be very expensive to replace the sling member, and even more costly to replace the entire sling chair. Further, as will be understood by someone with ordinary skill in the art, because a "sling" is a single member, insertion of a new "sling" into a sling frame is resource intensive and requires knowledge and skill in order to properly fit a new sling into a sling frame.

As will be understood by someone with ordinary skill in the art, sling chair frames may comprise various rail and rail channel configurations. Top plan views of various exemplary sling chair frame and frame rail configurations are depicted in FIGS. 6A through 6D. FIGS. 6A through 6D depict exemplary sling element (602) with exemplary sling chair arms (610) and sling chair seat edge (611) in relation to the various sling chair rail (600, 600', 600", 600'")/channel (603, 603', 603", 603'") configurations. As depicted, sling chair frames may comprise frame rail channels along the chair's front (chair rail channel 603 in front of chair rail 600 as depicted in FIG. 6A), in the exterior sides of the chair rails (chair rail channel 603' in exterior side of chair rail 600' as depicted in FIG. 6B), in the rear of the chair rails (chair rail channel 603" in rear of chair rail 600" as depicted in FIG. 6C), in the interior sides of the chair rails (chair rail channel 603'" in interior side of chair rail 600'" as depicted in FIG. 6D), or in some offset variation.

As will be understood by someone with ordinary skill in the art, exemplary embodiments of the above-mentioned Holbrook segment could be used to replace a sling member if the corresponding sling frame happened to have top/front channels as depicted in FIG. 6A. However, as will be understood by someone with ordinary skill in the art, because of their stiffness, Holbrook segments would not be useable with metal frames comprising rail channels in the frame's outer sides (as depicted in FIG. 6B), in the rear of the frame (as depicted in FIG. 6C), or in the inner sides of the frame (as depicted in FIG. 6D). Further, for the reasons mentioned previously above, using Holbrook segments involve expensive injection molding processes and would not be commercially feasible for use to replace a sling element for an individual chair.

A way is needed to inexpensively provide web-strapping for furniture.

A way is needed to inexpensively convert or retrofit sling furniture to strapped furniture.

SUMMARY OF THE INVENTION

Exemplary embodiments of the present invention would provide web-strapped furniture and methods of web-strapping furniture. In particular, Exemplary embodiments of the present invention would provide web-strapping for upholstery of furniture, methods of providing web-strapping for upholstery of furniture, web-strapped furniture, and methods of web-strapping furniture.

One exemplary embodiment of the present invention would provide an exemplary strap assembly of material for furniture upholstery comprising at least one fastener fastened into each end of the strap such that a tail end of each fastener is secured from extraction from the strap. In one exemplary strap assembly embodiment, fasteners would be fastened in each corner of each end of a strap so that a tail end of each fastener would be secured from extraction from the strap. Other exemplary embodiments would provide an exemplary article of furniture and methods of making an exemplary article of furniture, comprising said strap assemblies installed to span a space between opposing chair rails.

One exemplary embodiment of the present invention would provide, as described further below, an exemplary strap assembly of material for furniture upholstery, said strap assembly comprising: a first fastener fastened into a first end portion of a first end of a first strap, a tail end of said first fastener secured from extraction from said first strap; and a second fastener fastened into a first end portion of a second end of said first strap, a tail end of said second fastener secured from extraction from said first strap.

In one exemplary strap assembly embodiment, said first end portion of said first end of said first strap would comprises a first corner portion of said first end of said first strap, and said first end portion of said second end of said first strap would comprise a first corner portion of said second end of said first strap, said exemplary strap assembly would further comprise: a third fastener fastened into a second corner portion of said first end of said first strap, a tail end of said third fastener secured from extraction from said first strap; and a fourth fastener fastened into a second corner portion of said second end of said first strap, a tail end of said fourth fastener secured from extraction from said first strap.

One exemplary embodiment of the present invention would provide an exemplary article of furniture, and methods for making such an exemplary article of furniture, that would comprise: a first side rail comprising a channel traversing a length of said first side rail; a second side rail comprising a channel traversing a length of said second side rail, said second side rail being separated from said first side rail by a space interval; and a strap comprising two ends, each end of said two ends comprising two corner portions, wherein each end of said two ends comprises a first fastener and a second fastener, wherein each of the first fastener and the second fastener are secured in respective corner portions of said two corner portions, a first end of said strap being slid into the channel of said first side rail, and a second end of said strap being slid into the channel of said second side rail so that said strap spans said space interval between said first side rail and said second side rail.

BRIEF DESCRIPTION OF THE DRAWINGS

These and other features of the present invention are more fully set forth in the following description of exemplary embodiments of the invention. The description is presented with reference to the accompanying drawings in which:

FIG. 5A depicts an illustrative "sling" element side;

FIG. 5B depicts an illustrative "sling" chair rail and channel;

FIG. 5C depicts an illustrative "sling" element side inserted in an illustrative "sling" chair rail channel;

FIG. 19 depicts a perspective view of an alternative exemplary embodiment of a strap end clip clamped around an end of an exemplary strap and with exemplary rivets fastened there through;

DETAILED DESCRIPTION OF THE INVENTION

Figure 1:
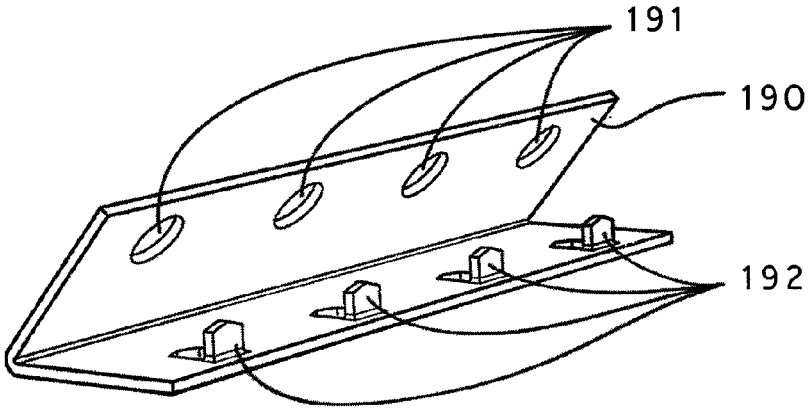
FIG. 1 depicts a PIRELLI clip.
Figure 2:
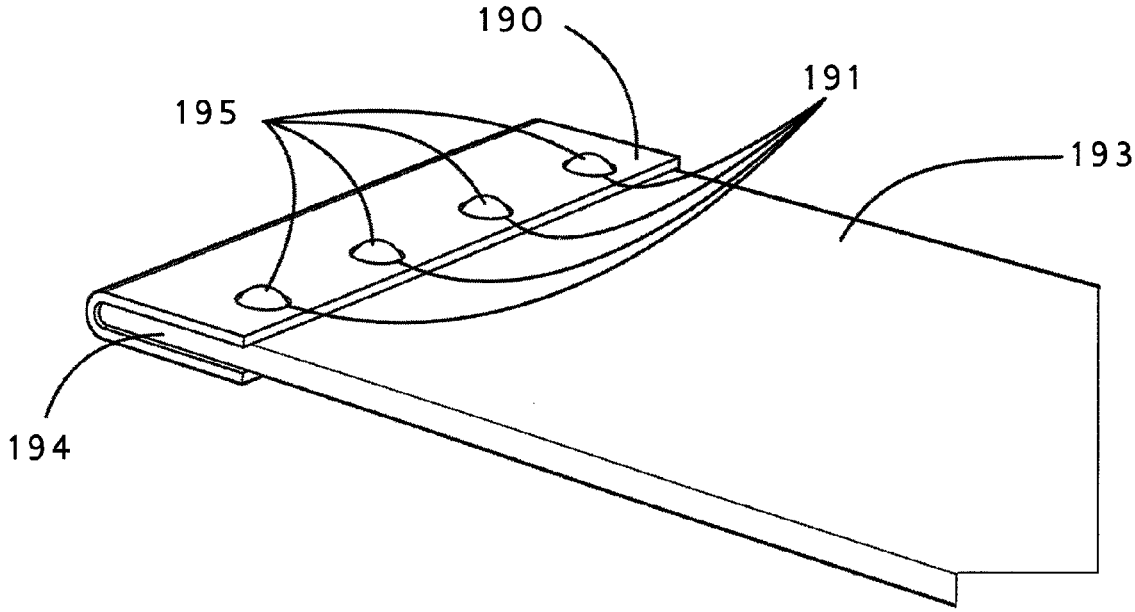
FIG. 2 depicts a PIRELLI clip attached to an end of a strap.
Figure 3:
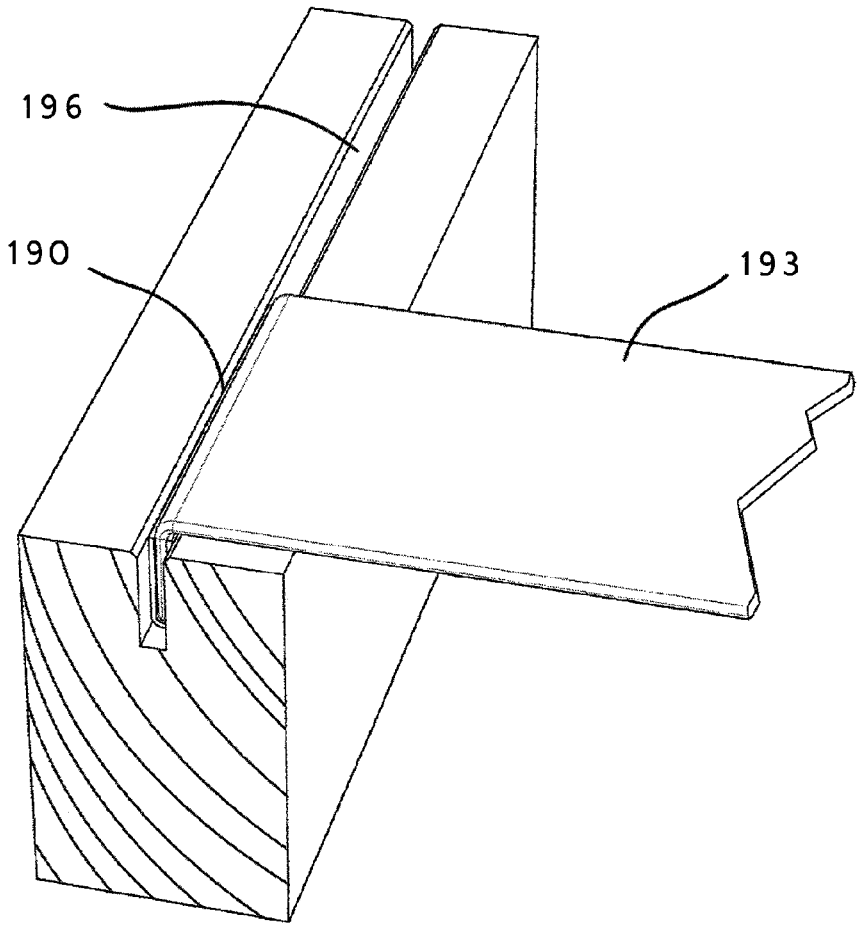
FIG. 3 depicts a PIRELLI-clipped end of a strap inserted into a wooden rail slot.
Figure 4:
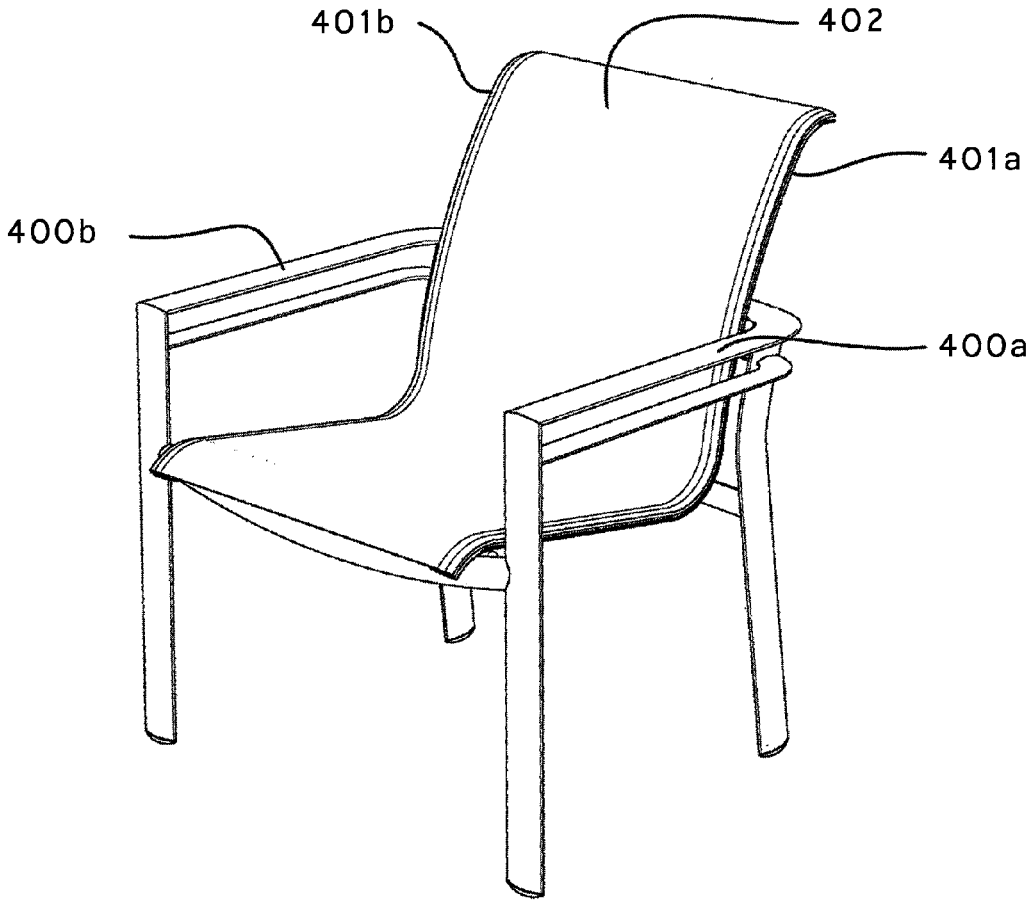
FIG. 4 depicts an illustrative "sling" chair with an exemplary metal frame.
Figure 4A:
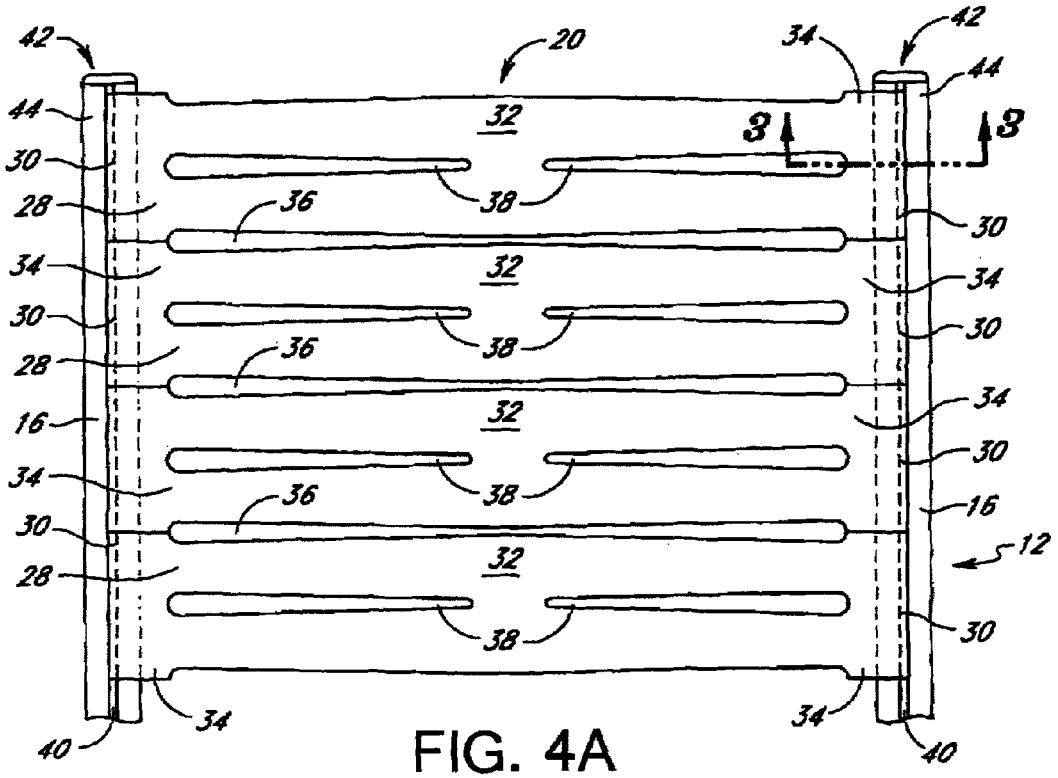
Figure 4B:
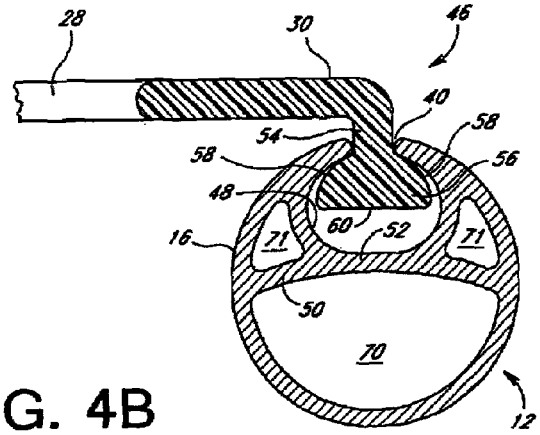
Figure 6A:
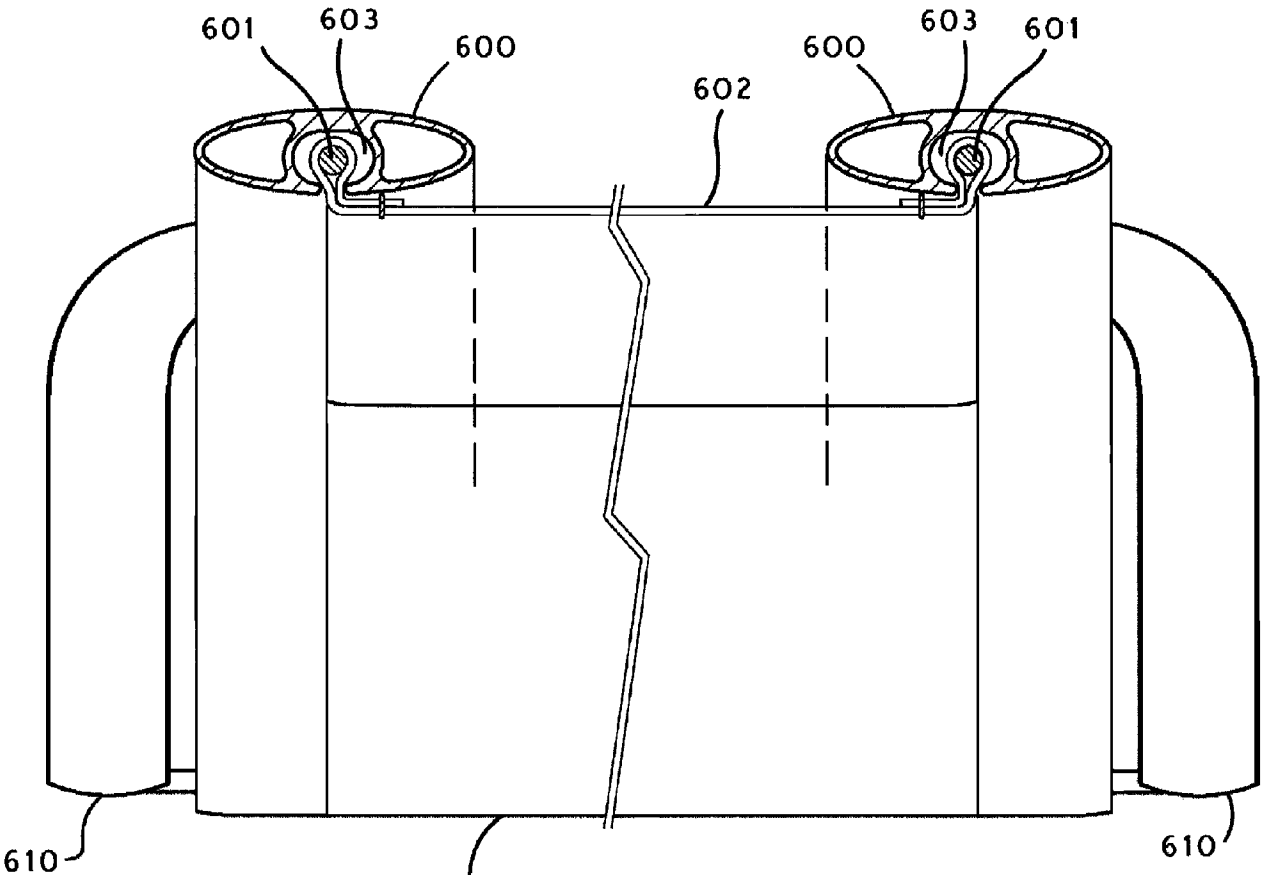
FIGS. 6A through 6D depict illustrative front, exterior side, rear and interior side rail channels respectively.
Figure 6B:
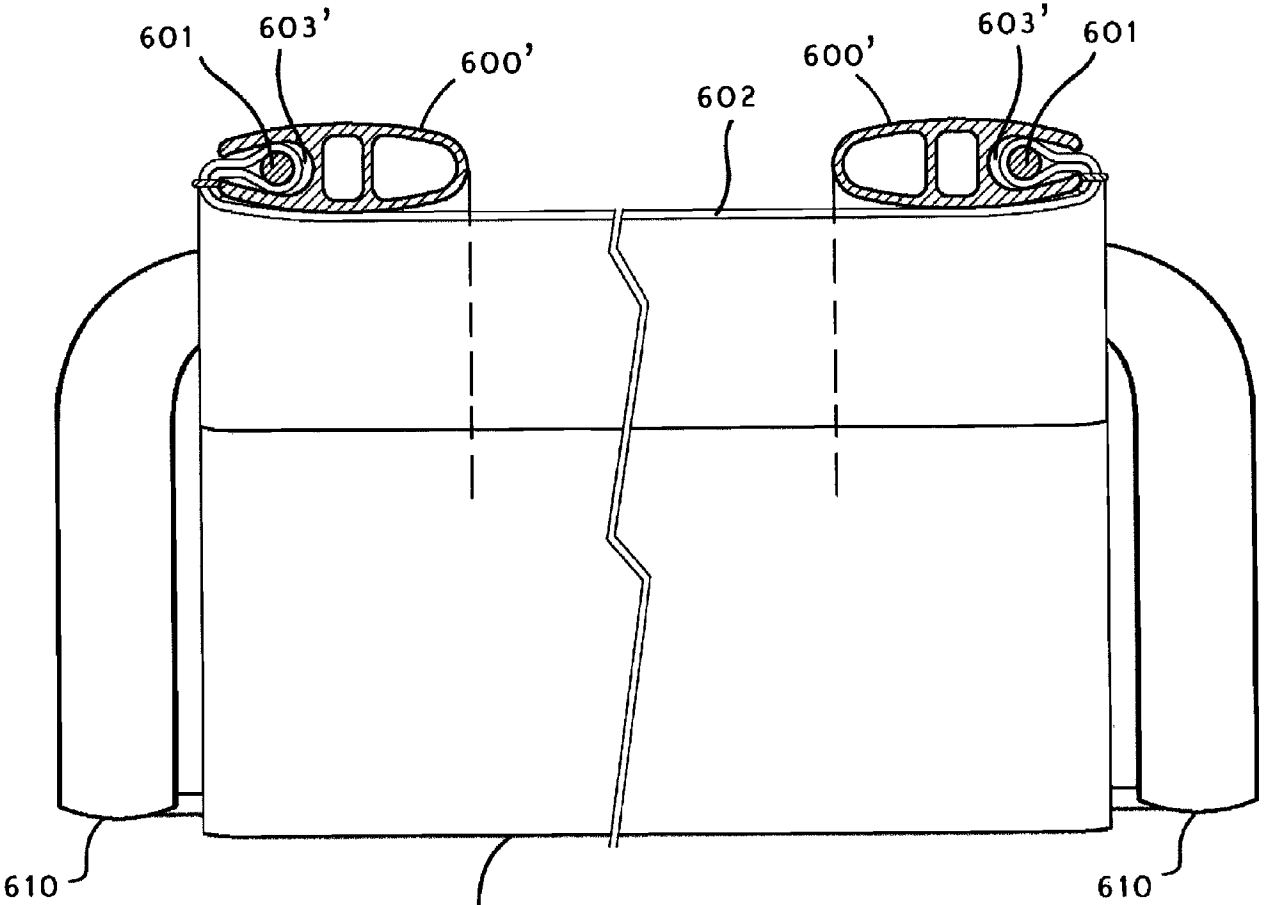
Figure 6C:
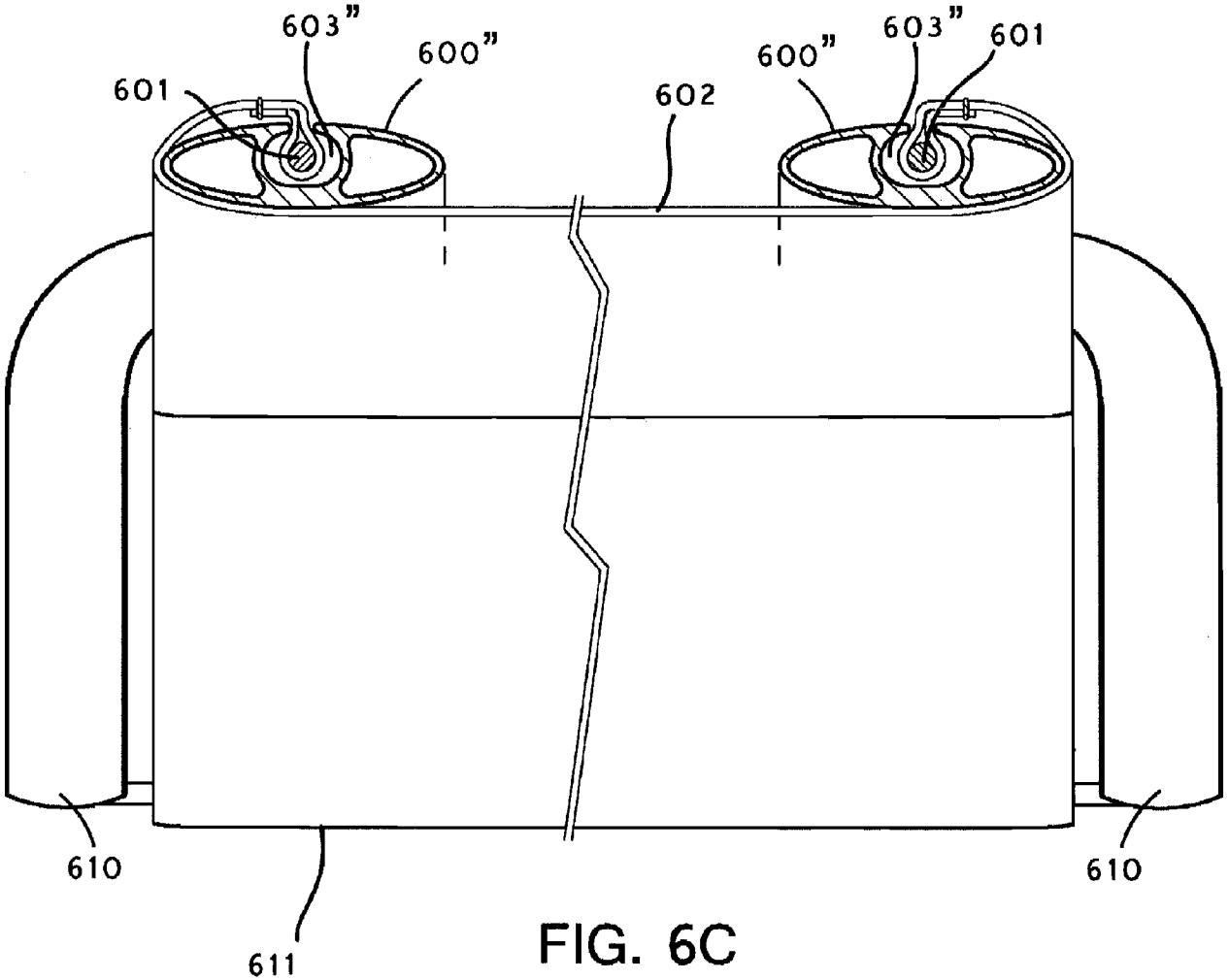
Figure 6D:
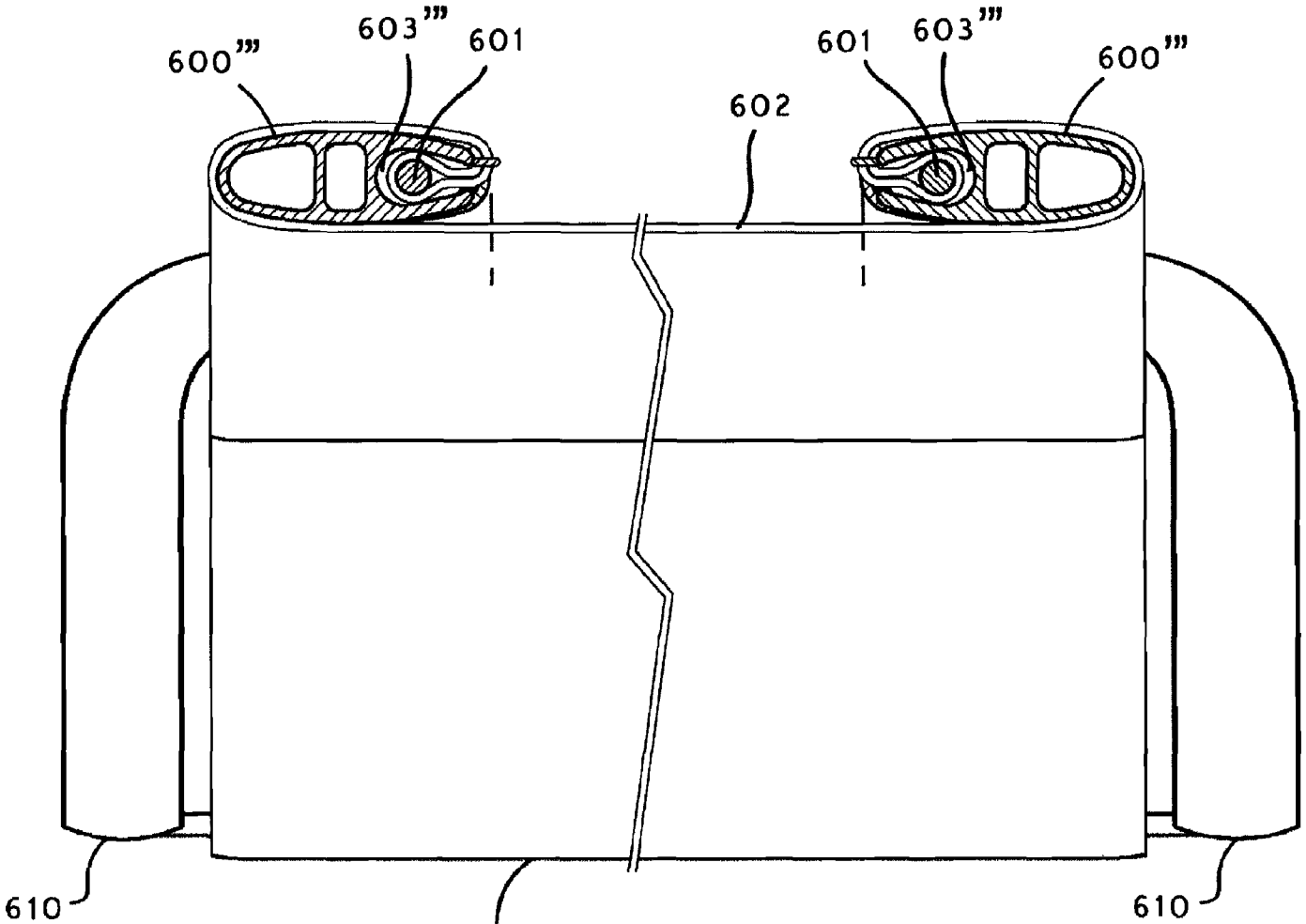
Figure 7:
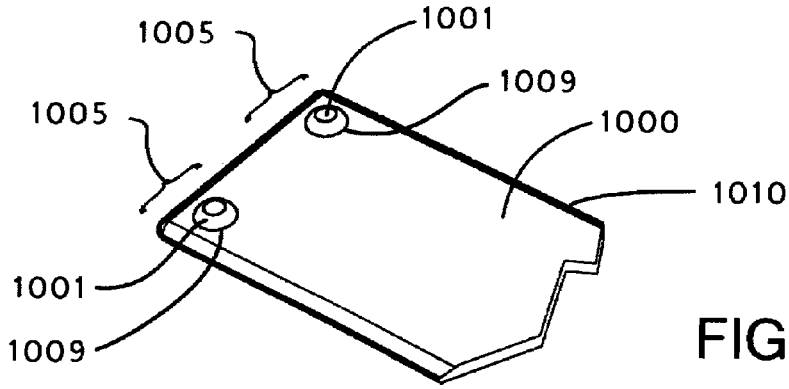
FIGS. 7-12 depict various perspective and plan views of an exemplary end of an exemplary strap that has been riveted and prepared for securing into a sling-rail channel in an exemplary embodiment of the present invention.
Figure 8:
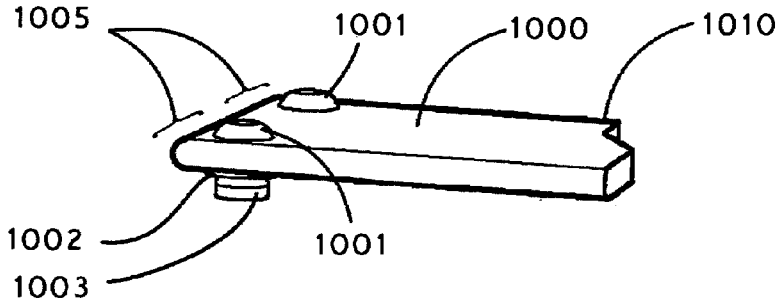
Figure 9:
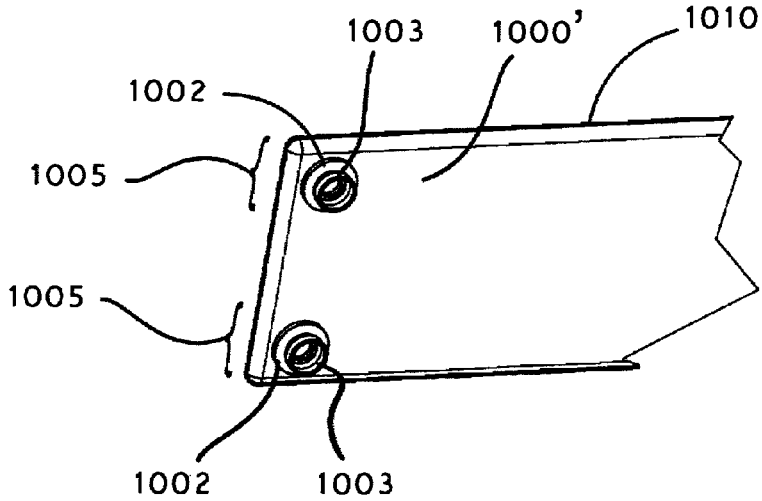

With reference to FIGS. 7-9, exemplary embodiments of the present invention would drive exemplary rivets through an exemplary pre-drilled or pre-punched hole 1009 in exemplary end corner portions 1005 of each end of an exemplary strap 1010.

As will be understood by someone with ordinary skill in the art, in alternative embodiments, instead of pre-drilling or pre-punching holes (1009) in strap end corner portions, it would be possible to drive certain types of fasteners (e.g., sharp-tipped fasteners) through a strap without pre-forming a hole; such embodiments would not depart from the spirit of the present invention.

However, as will be understood by someone with ordinary skill in the art, the fastening of an exemplary rivet as described herein, through a pre-formed hole in a corner portion of a strap end would create a fastening "head" on both sides (the top side 1000 and the underside 1000') of the strap. That is because, as will be understood by someone with ordinary skill in the art, before fastening, a rivet comprises a cylindrical shaft with a head (sometimes referred to as a "factory head") on one end, and what is sometimes referred to on the opposite end as a tail—the tail end is blunt. Installation of a rivet involves placing the cylindrical shaft of the rivet through a punched or pre-drilled hole and then deforming the tail end (sometimes referred to as "upsetting" or "bucking" the tail end). The deformation of the tail end of the rivet expands the diameter of the rivet shaft that is below the riveted material; the deformed end of an installed rivet is sometimes referred to as a "shop head." As a result of the above-mentioned deformation, once installed, the rivet has two heads, namely, the "factory head" that is above the riveted material, and the "shop head" (also sometimes referred to as a "buck-tail") that is formed below the riveted material. Because there is effectively a head on each end of an installed rivet, then when a shear load, (i.e., that is perpendicular, or substantially or relatively perpendicular, to the axis of the shaft of the rivet) is exerted against such an installed rivet that is in a rail channel 603 (see FIG. 15), such as could be caused by the weight of an occupant of the furniture against the strap anchored by the rivet, the two heads of the rivet would move toward the opening 619' (see, e.g., FIGS. 24-26) of the subject channel until the two heads abut against the opening portions 619 of the rail channel 603 (see FIG. 15) and thereby resist extraction from the opening 619' (see, e.g., FIGS. 24-26) of the rail channel, e.g., see 603", FIGS. 24-26. As will be described further below, a strap with rivets installed as described herein is suited to supporting shear loads that would be exerted against the rivets as could be caused by the weight of a person sitting in an article of furniture embodying straps installed according to an exemplary embodiment of the present invention.

In one embodiment, vinyl straps would be used. However, as will be understood by someone with ordinary skill in the art, the present invention is not limited to vinyl straps but rather may be used with straps comprising other materials whether now known or in the future discovered. Further, although exemplary solid straps are depicted in the exemplary drawings, as will be understood by someone with ordinary skill in the art, use of solid straps is not a limitation of the present invention. Rather, perforated straps, mesh material, or other materials, whether now known or in the future discovered, could be used as straps without departing from the spirit of the present invention.

Further, in one exemplary embodiment, stainless steel rivets and washers would be used. However, as will be understood by someone with ordinary skill in the art, the present invention is not limited to rivets of any particular material. Rather, rivets, and other types of fasteners, whether of stainless steel, aluminum, titanium, or other materials whether now known or in the future discovered, could be used without departing from the spirit of the present invention. For example, in some embodiments, it would be possible to use screws with washers, or other types of fasteners.

Once inserted into an exemplary hole 1009 in an exemplary strap 1010, an exemplary head end 1001 of each rivet would rest on a top surface 1000 of the corresponding end corner portion 1005 of the strap 1010. The cylindrical tail end (not shown) of the exemplary rivet would be inserted through the exemplary hole 1009, so that it would protrude through a bottom surface 1000' of the exemplary strap 1010; the rivet would be installed to secure the rivet in strap 1010 by deforming the tai end of the rivet into a "shop head" 1003 of the rivet. That is, exemplary installation of the rivet would involve the deformation of the tail end 1003—a deformed tail "shop head" 1003 of an installed rivet is depicted, for example, in FIGS. 8, 9, 11, 12, 13, 14A, 14B, 15, and 17.

In one embodiment, individual washers 1002 would be used on the underside 1000' of the strap 1010 through which the cylindrical tail end of the rivet would protrude before performing the above-mentioned installation/deformation process to form the deformed tail "shop head" 1003 illustratively depicted in FIGS. 8, 9, 11, 12, 13, 14A, 14B, 15, and 17.

The drawings illustratively depict exemplary use of what are sometimes called "POP" (blind) rivets. However, as will be understood by someone with ordinary skill in the art, there are various types of rivets and other types of fasteners, that could be used without departing from the spirit of the present invention. For example, there are, among others, various types of tubular rivets, semi-tubular rivets, solid rivets and drive rivets that could be used without departing from the spirit of the present invention.

As will be understood by someone with ordinary skill in the art, straps of various widths could be used with the present invention. For example, for a single article of furniture, straps of various widths and colors could be used to provide a particular design, such as, for example, alternating widths and colors. For wider straps, in addition to fastening rivets in each corner portion 1005, additional rivets could be placed in between the corner-portion rivets as illustratively depicted in FIG. 10. For narrower straps (not shown), it would be possible to fasten a single rivet (or other fastener) in each end of the strap, such as at an approximate middle of the strap width.

It will be understood by someone with ordinary skill in the art that the description herein of a "width" of a strap will refer to what is sometimes called the "height" of a strap—that is, reference herein to the "width" of a strap shall not refer to the distance between two opposing rails of an item of furniture; rather, the term "width" of a strap shall be understood to refer to the height of the strap from one edge along the length of the strap to the opposing edge along the length of the strap.

Figure 11:
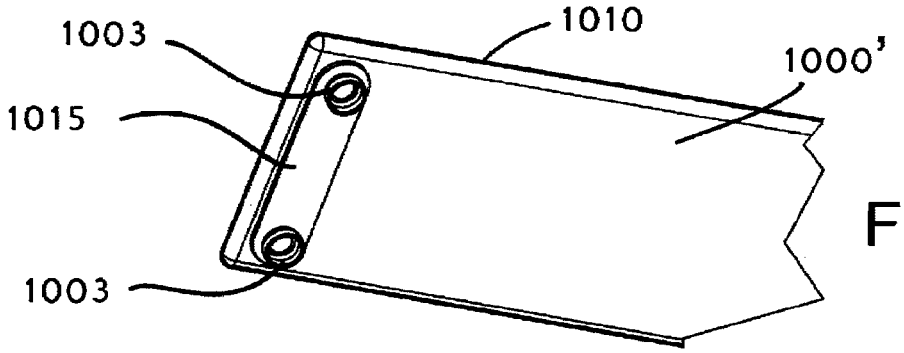

In an alternative exemplary embodiment, as illustratively depicted in FIG. 11, an exemplary washer strip 1015 would be used on the underside 1000' of the strap 1010 through which the cylindrical tail ends 1003 of the rivets would protrude before deformation of the tail ends 1003 of the rivets.

In a further alternative exemplary embodiment, both an exemplary strip 1015' (which could be either a metal washer strip or a reinforcing strip of material, such as material similar to the strap 1010) and exemplary washers 1002 would be used. In such a further alternative exemplary embodiment, the exemplary strip 1015' could be made of vinyl or other material similar to the strap 1010.

Figure 19:
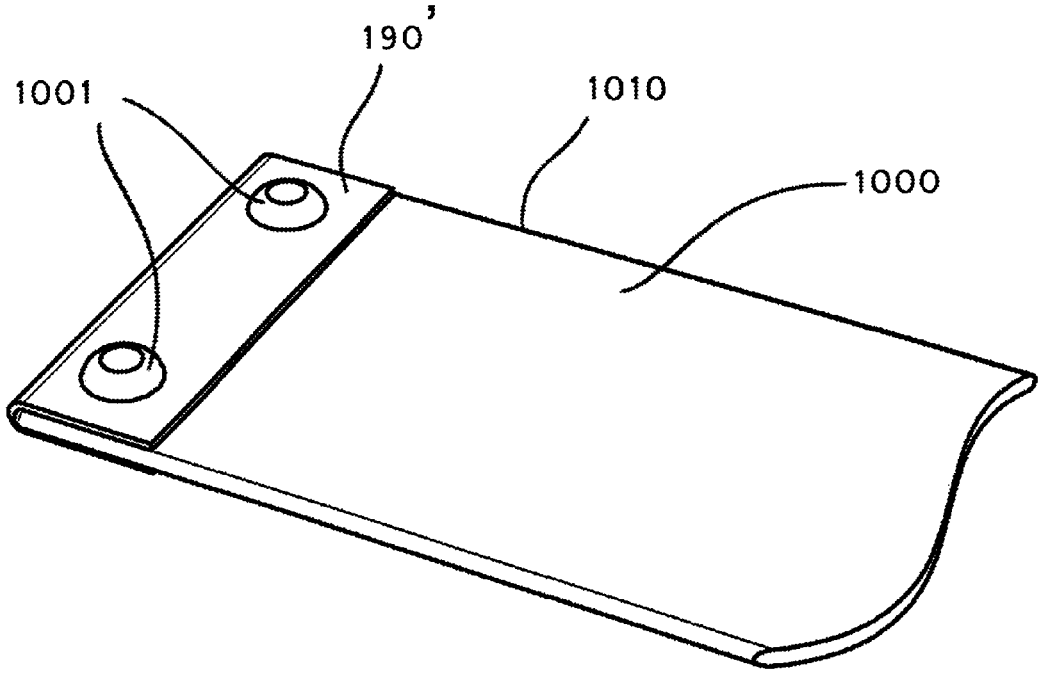

In yet a further alternative exemplary embodiment, rivets (as can be seen as rivet heads 1001) could be inserted through holes (not shown) in an exemplary clip 190' that had been clamped over an end of a strap 1010 as depicted in FIG. 19.

Figure 10:
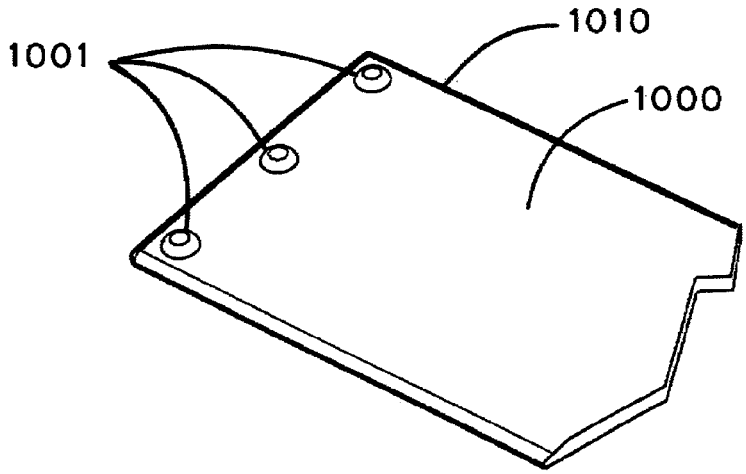
Figure 12:
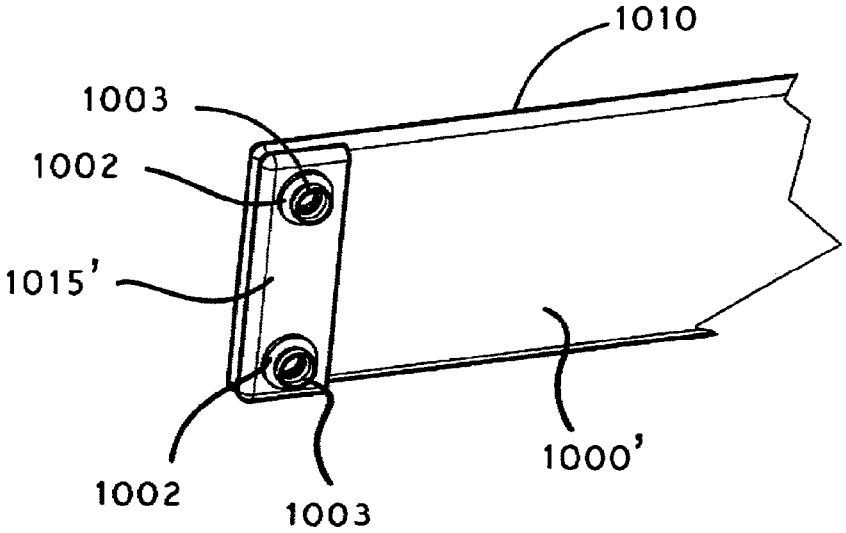

As will be understood by someone with ordinary skill in the art, alternative embodiments such as illustratively depicted in FIGS. 11, 12 and 19, would require exemplary washer strips 1015 (FIG. 11), exemplary reinforcing strips 1015' (FIG. 12) or exemplary clips 190' (FIG. 19) of predetermined length that would match, or be closely dimensioned with, the width of a strap 1010 on which the respective strips or clips are to be fastened; whereas the independent fastening of rivets (or other types of fasteners) in the strap end corner portions 1005 as depicted, for example, in FIGS. 7, 8, and 9 would be independent of the width of any particular strip; additional rivets could be applied in between the strap corner portions for wider strips as depicted illustratively in FIG. 10.

As will be understood by someone with ordinary skill in the art, the independent fastening of rivets (or other types of fasteners) in strap end corner portions 1005 as depicted, for example, in FIGS. 7, 8, 9 and 10 would not require alignment with any washer strip, reinforcement strip or clip holes.

Figure 18:
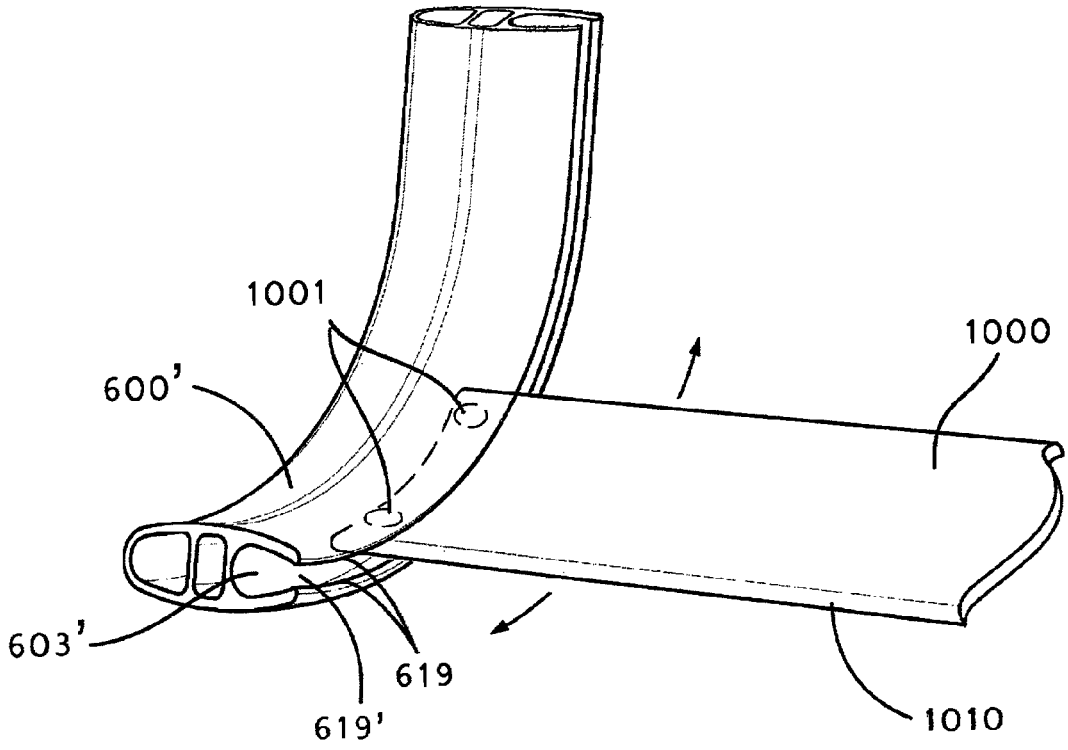
FIG. 18 depicts a perspective view of a back-to-seat transition radius of an exemplary sling chair rail and depicts an exemplary end of a strap with an exemplary embodiment of a strap end fastening in an exemplary embodiment of the present invention being slid through the sling chair rail back-to-seat transition radius.

Yet further, as will be understood by someone with ordinary skill in the art, the independent fastening of rivets (or other types of fasteners) in strap end corner portions 1005 as depicted, for example, in FIGS. 7, 8, and 9, and including embodiments involving additional intermediate rivets as depicted in FIG. 10, would allow the end of the strap 1010 to flex through a channel at a back-to-seat transition rail radius as depicted in FIG. 18; whereas embodiments involving strap-end washer strips 1015 (FIG. 11), reinforcing strips 1015' (FIG. 12) or clips 190' (FIG. 19) could, depending on the material used for such a washer strip 1015 (FIG. 11), reinforcing strip 1015' (FIG. 12) or clip 190' (FIG. 19), be stiff such that it would not be flexible enough to get around a back-to-seat transition rail corner or radius such as for a sling chair frame. As will be understood by someone with ordinary skill in the art, the flexibility of strap ends in independent rivet fastening embodiments as depicted in FIGS. 7, 8, 9 and 10 would be beneficial in retrofitting a sling chair with straps as described further below.

In some embodiments, relatively flexible material, such as, for example, vinyl, could be used to provide an exemplary strip such as exemplary reinforcing strip 1015' (FIG. 12). In such an embodiment, the flexible material strip would flex around a transitional rail corner of a sling chair frame. The description of an exemplary use of vinyl as a reinforcing strip 1015' (and for 1015") is illustrative and not a limitation of the present invention; other materials whether now known or in the future discovered could be used without departing from the spirit of the present invention.

Figure 21:
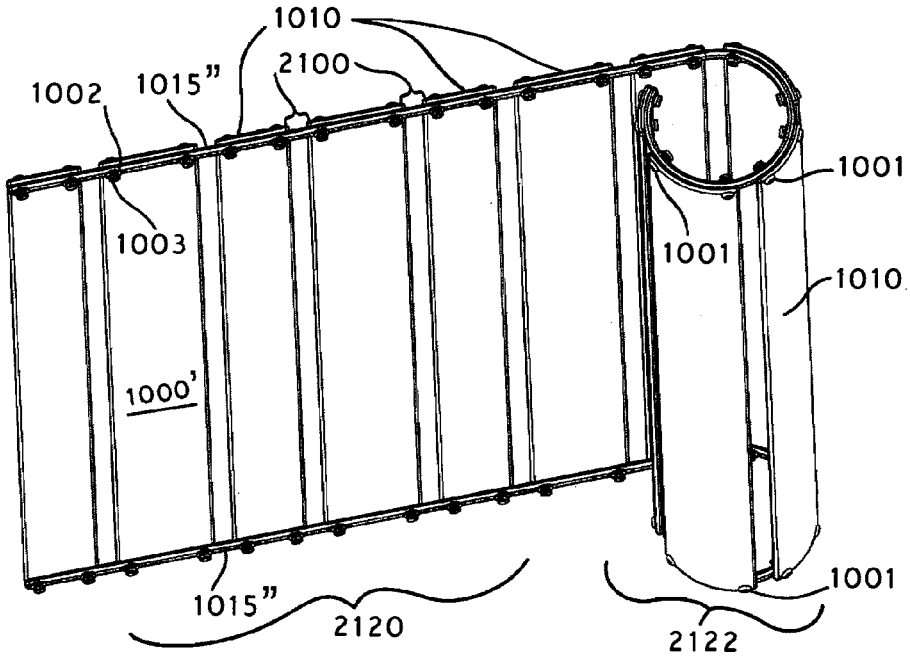
FIGS. 21 and 22 depict perspective views of exemplary multiple-strap web-strapping assemblies in an exemplary embodiment of the present invention.
Figure 22:
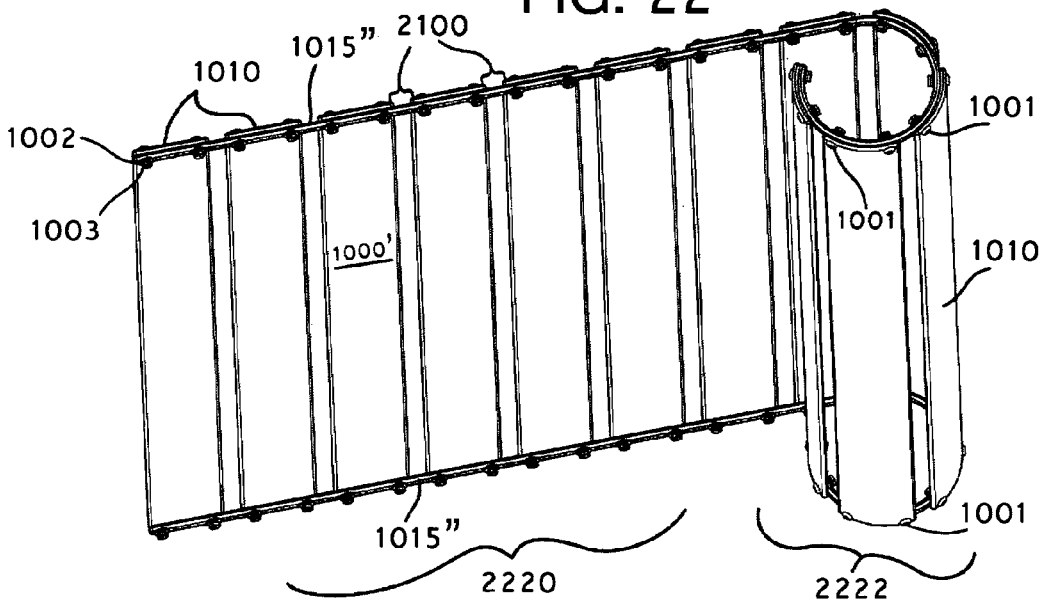

FIGS. 21 and 22 depict exemplary multiple-strap web-strapping assemblies 2120 and 2220 respectively, of multiple straps 1010 where each strap 1010 is fastened at their respective ends with rivets to an exemplary continuous reinforcing strip 1015". Exemplary multiple-strap web-strapping assembly 2120 depicted in FIG. 21 comprises exemplary straps 1010 of varying widths fastened at each end to exemplary continuous reinforcing strips 1015" using exemplary strap end/fastener assemblies (as illustratively depicted as exemplary rivet heads 1001, exemplary rivet "shop heads" 1003 and (optionally) exemplary washers 1002).

Exemplary multiple-strap web-strapping assembly 2220 depicted in FIG. 22 comprises exemplary straps 1010 each having the same strap width; the ends of each strap 1010 being fastened to exemplary continuous reinforcing strips 1015" using exemplary fasteners (as illustratively depicted as exemplary rivet heads 1001, exemplary rivet "shop heads" 1003 and (optionally) exemplary washers 1002).

Figure 24:
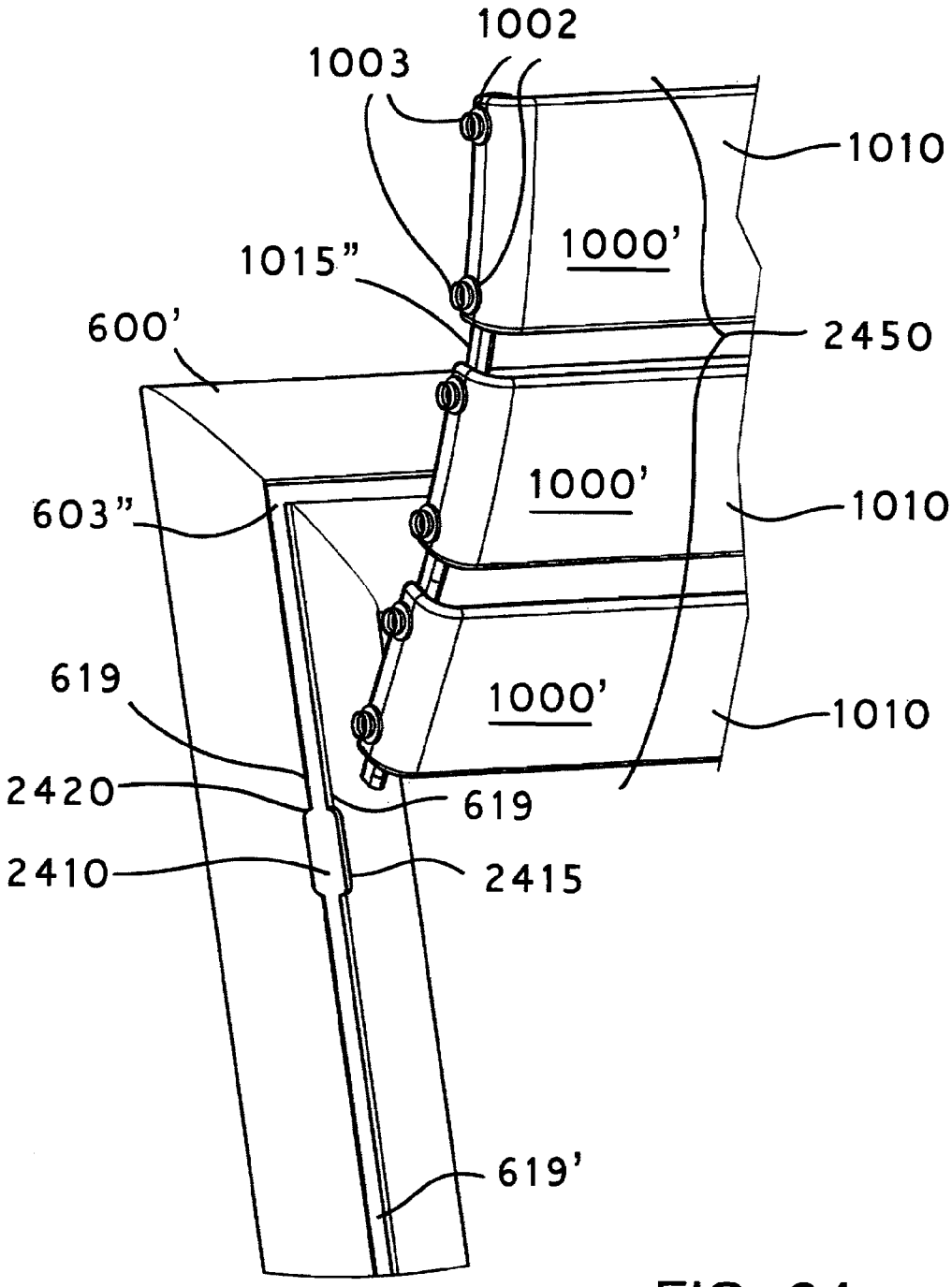
FIGS. 24-26 depict perspective views of exemplary multiple-strap web-strapping assemblies positioned for insertion into an exemplary web-strapping installation port in an exemplary chair side rail in an exemplary embodiment of the present invention.

In the exemplary embodiments depicted in FIGS. 21 and 22, exemplary continuous reinforcing strips 1015" would comprise continuous strips of material that would be fastened to the underneath side 1000' of exemplary straps 1010 by exemplary fastener assemblies (as illustratively depicted as exemplary rivet heads 1001, exemplary rivet "shop heads" 1003 and (optionally) exemplary washers 1002). However, an underneath-strap location for exemplary continuous reinforcing strips 1015" is not a limitation of the invention. Rather, in other exemplary embodiments, such as depicted in FIG. 24, exemplary continuous reinforcing strips 1015" would be fastened to the top side of exemplary straps 1010 by exemplary rivet assemblies (as illustratively depicted as exemplary rivet "shop heads" 1003 and (optionally) exemplary washers 1002).

In yet further alternative exemplary embodiments (not shown), rather than fastening an exemplary continuous strip with exemplary rivets to exemplary straps, the exemplary continuous strip would be fastened to the straps (either to the underside or to the top side of the straps) by other fastening approaches, such as with heat-bonding, stitches, glue, or other fastening devices, chemicals or other means, whether now known or in the future discovered. In such an embodiment where exemplary continuous strips are fastened to exemplary straps using fastening approaches other than the rivets or other fasteners that are to be lodged in an exemplary rail channel, the exemplary continuous strips would not reinforce the fastening of the rivets or other fasteners to the ends of the straps, but would facilitate spacing straps from each other, and would facilitate creating rollable lengths of straps, or rolls of straps, so attached to such exemplary continuous strips. In such an embodiment, the exemplary continuous strips would not necessarily be lodged inside a rail channel when the rivet-fastened ends of straps attached to such exemplary continuous strips are inserted into the rail channel. In some such embodiments, such as in embodiments where there is no space interval between straps, the exemplary continuous strips could be removed once a roll of straps is installed for a particular item of furniture.

In the exemplary embodiments depicted in FIGS. 21 and 22, an exemplary space interval 2100 is depicted between each strip 1010. Exemplary space intervals 2100 between exemplary straps could vary in size from zero (i.e., the straps would be next to each other), to, for example, an inch or less. The description of an inch or less as an exemplary measurement of an exemplary space interval 2100 is illustrative and is not a limitation of the invention.

As depicted in FIGS. 21 and 22, exemplary continuous reinforcing strips 1015" could be used in some exemplary embodiments to separate each strap 1010 from neighboring straps by an exemplary space interval 2100. Exemplary continuous reinforcing strips 1015" comprising a flexible material would facilitate a rolling, such as depicted by exemplary rolled assembly portions 2122 and 2222 of a length of exemplary assemblies, e.g., 2120 and 2220 respectively.

Figure 23:
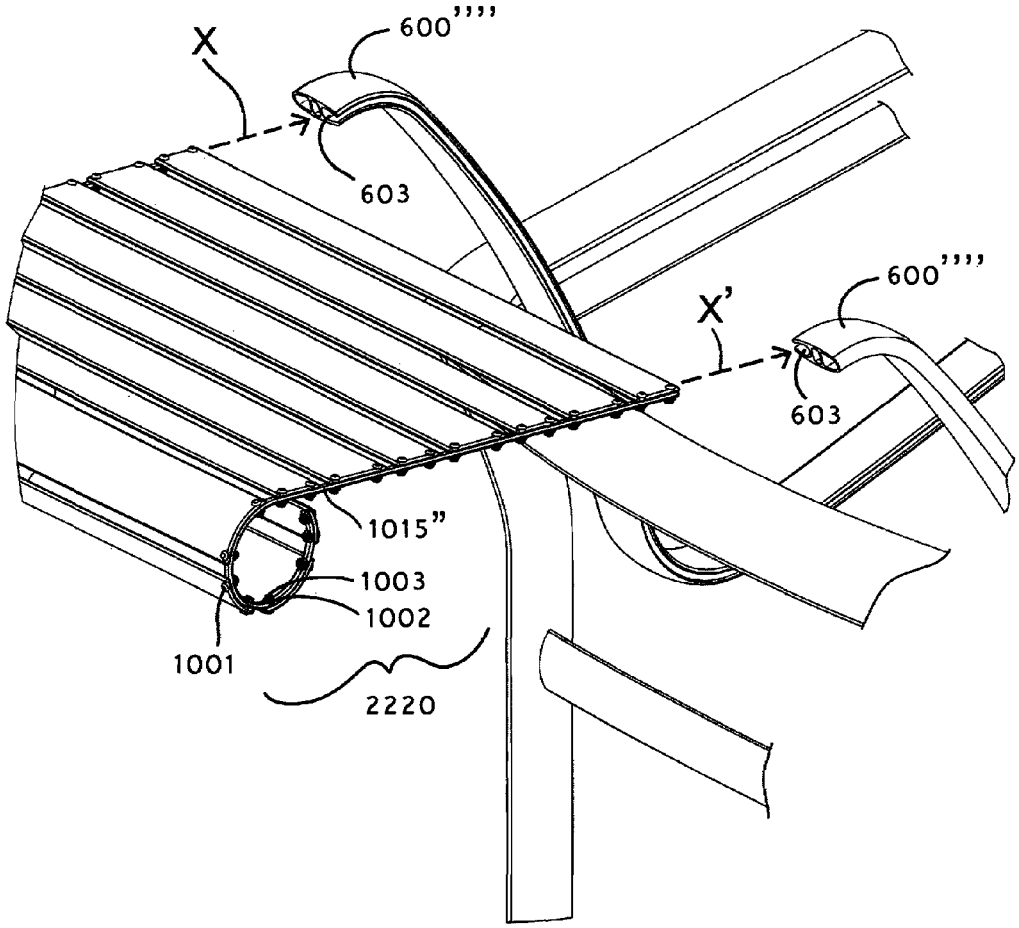
FIG. 23 depicts a perspective view of an exemplary multiple-strap web-strapping assembly positioned for insertion into open-ended channels of exemplary chair side rails in an exemplary embodiment of the present invention.

FIG. 23 depicts an exemplary multiple-strap web-strapping assembly 2220 positioned for exemplary insertion (along exemplary directional lines X and X') into exemplary sling rail chair rail channels 603 in exemplary interior-side-channel chair rails 600"".

The exemplary chair rails 600"" depicted in FIG. 23 are open-ended; because they are open-ended, exemplary web-strapping assembly 2220 can be inserted into exemplary sling rail chair rail channels 603 from the top, or upper-most position, of the channel 603 openings as depicted by exemplary directional lines X and X'. However, as will be understood by someone with ordinary skill in the art, some types of channel-railed furniture may be closed-ended, such as depicted in FIG. 24. The chair rails 600' depicted in FIG. 24, and those depicted in FIGS. 25 and 26 are not open-ended.

In order to facilitate installation of exemplary web-strapping assemblies, e.g., 2120, 2220, exemplary web-strapping assembly installation ports 2410 are illustratively depicted at one or more positions in each rail portion. As illustratively depicted in FIG. 24, an exemplary web-strapping assembly installation port 2410 would comprise exemplary indentations 2415 and 2420 in exemplary opening portions 619 of the rail channel 603".

Figure 25:
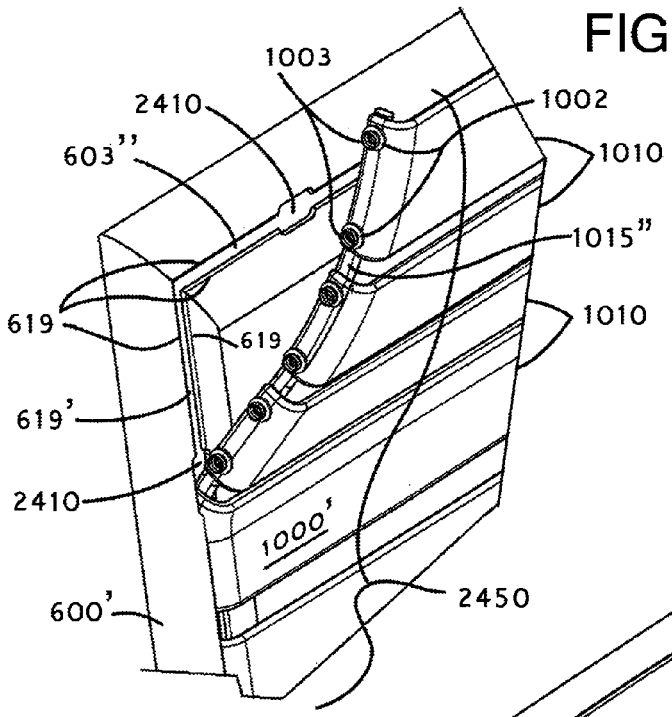
Figure 26:
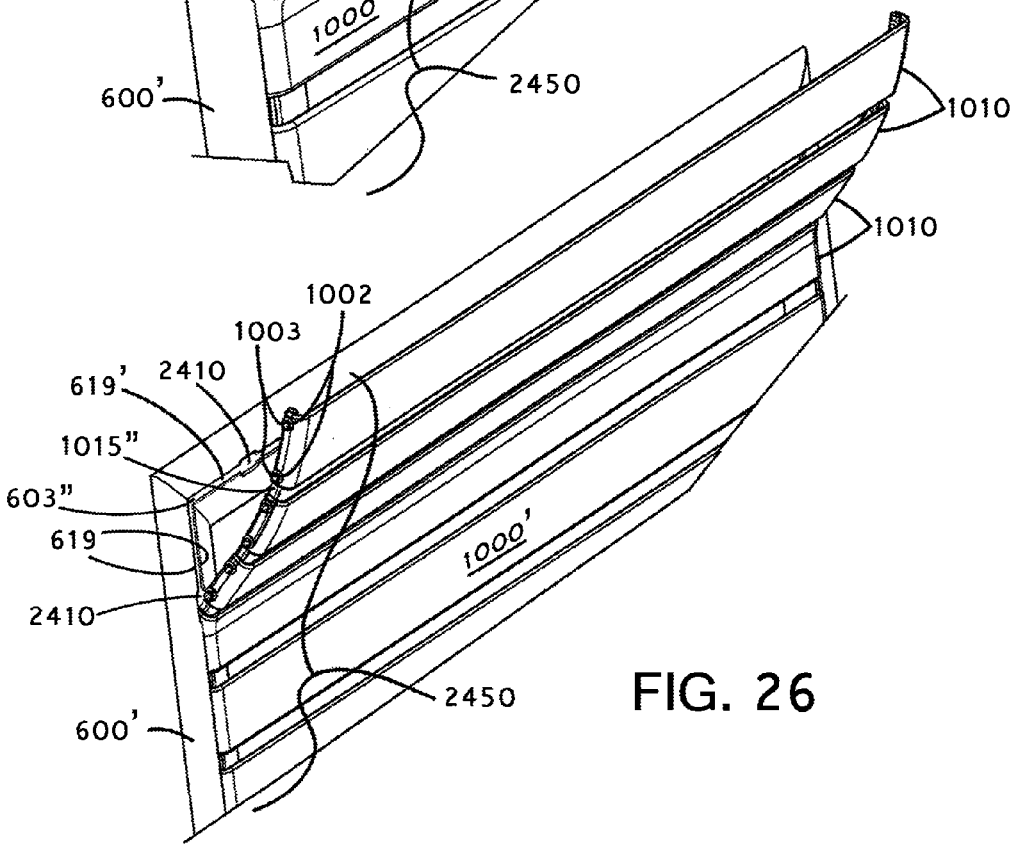

As will be understood by someone with ordinary skill in the art, an exemplary chair rail channel, e.g., 603" as depicted in FIGS. 24-26, may be visible through a narrow opening, depicted as exemplary opening 619', between exemplary channel opening portions 619.

In some exemplary embodiments, as depicted in FIG. 24, exemplary indentations 2415 and 2420 in exemplary opening portions 619 of an exemplary chair rail opening 619' in an exemplary chair rail channel 603" would be of the same length. In other exemplary embodiments, exemplary indentations 2415 and 2420 in exemplary opening portions 619 would have different lengths (e.g., one would be longer than the other).

Exemplary indentations 2415 and 2420 in exemplary opening portions 619 as illustratively depicted in FIG. 24 would provide an exemplary web-strapping assembly installation port 2410 (see FIGS. 24-26) of sufficient size (width and length) to accept insertion of an exemplary side 2450, including exemplary continuous reinforcing strip 1015" and exemplary strap-end/fastener assemblies (as illustratively depicted as exemplary rivet "shop heads" 1003 and (optionally) exemplary washers 1002) of an exemplary web-strapping assembly, e.g., 2120, 2220.

In some exemplary embodiments of exemplary web-strapping assembly installation ports 2410 (see FIGS. 24-26), exemplary port plugs (not shown) could be inserted into exemplary web-strapping assembly installation ports 2410 after installation of exemplary strap-end/fastener assemblies. Such exemplary port plugs could comprise a stopper made, for example, of rubber, that would accept insertion in the port opening but would resist, unless deformed, removal from the port.

Figure 13:
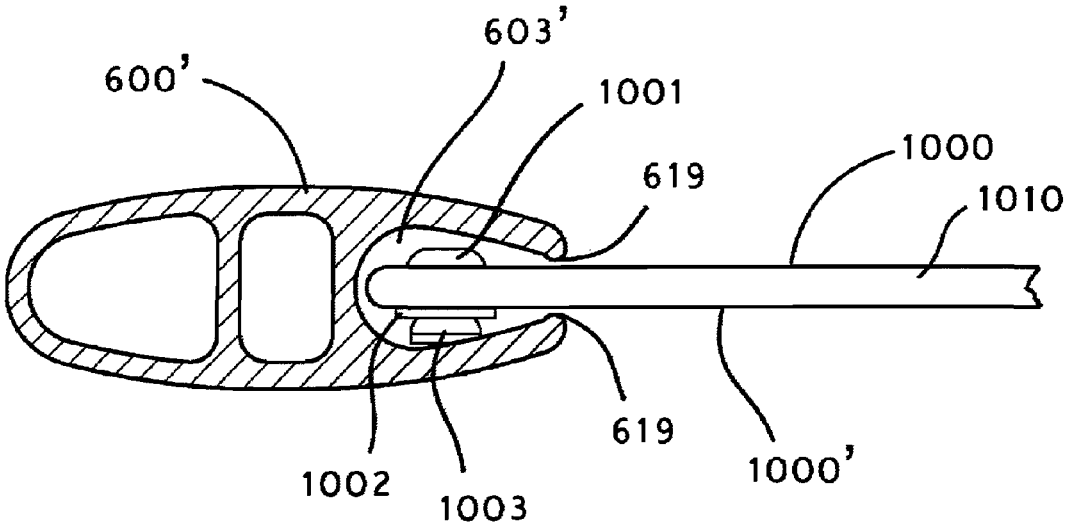
FIGS. 13, 14A-B and 15 depict top plan views of various railing and channel configurations into which an exemplary embodiment of an end of an exemplary riveted strap has been slid into an exemplary channel.

FIG. 13 depicts a top plan view of an exterior side channel railing 600' into which an exemplary embodiment of an end of an exemplary riveted strap has been slid into channel 603'. As depicted in FIG. 13, the head end 1001 and the tail end 1003 of the respective rivets (only one is visible in FIG. 13, because the second rivet is below the first in channel 603') interfere against removal of the strap end from channel 603'.

Figure 14A:
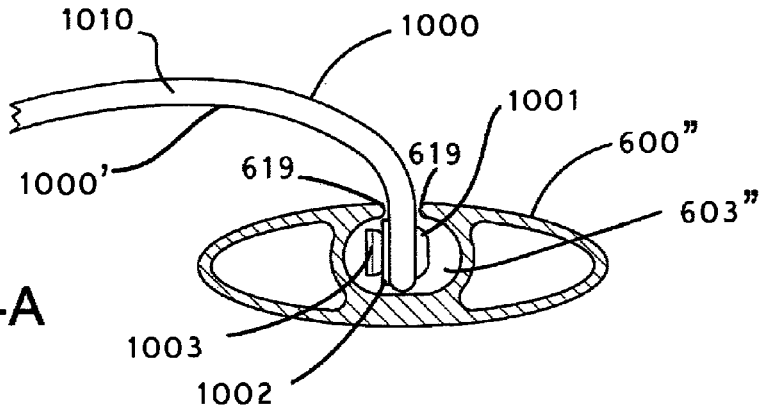
Figure 14B:
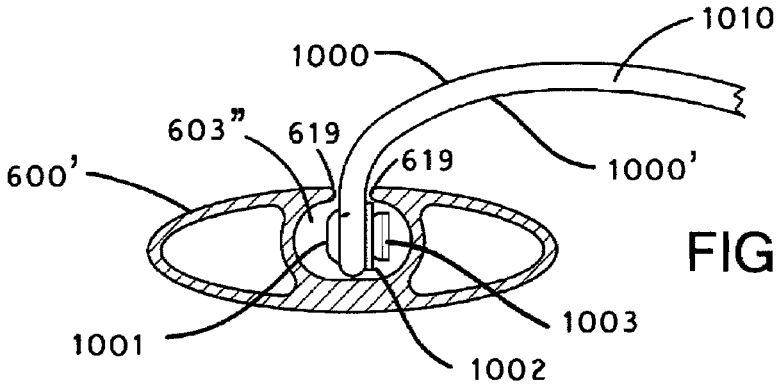
Figure 15:
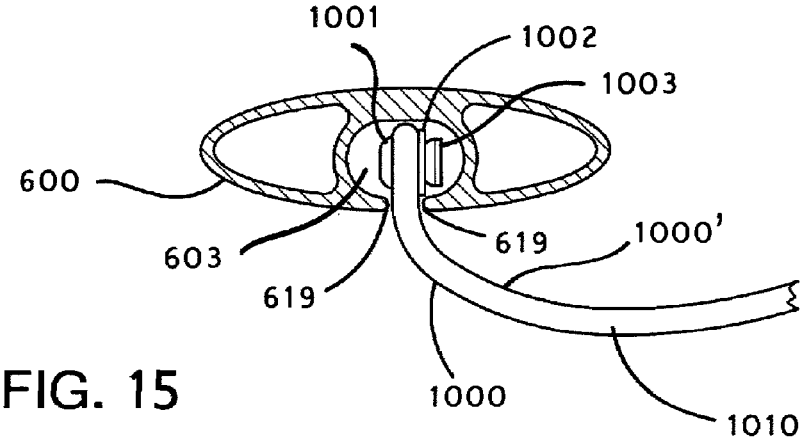

FIGS. 14A and 14B are top plan views of opposing rear channel railings 600" into which exemplary embodiments of ends of an exemplary riveted strap has been inserted in channel 603". FIG. 15 depicts a top plan view of a front channel railing 600 into which an exemplary embodiment of an end of an exemplary riveted strap has been inserted in channel 603.

As depicted in FIGS. 13, 14A-B and 15, in each case, the head end 1001 and the tail end 1003 of the respective rivets (only one is visible in each of FIGS. 13, 14A-B, and 15 because the second rivet is below the first in the depicted channels 603', 603" and 603 respectively) interfere against removal of the strap end from channel 603' through rail opening 619.

Figure 20:
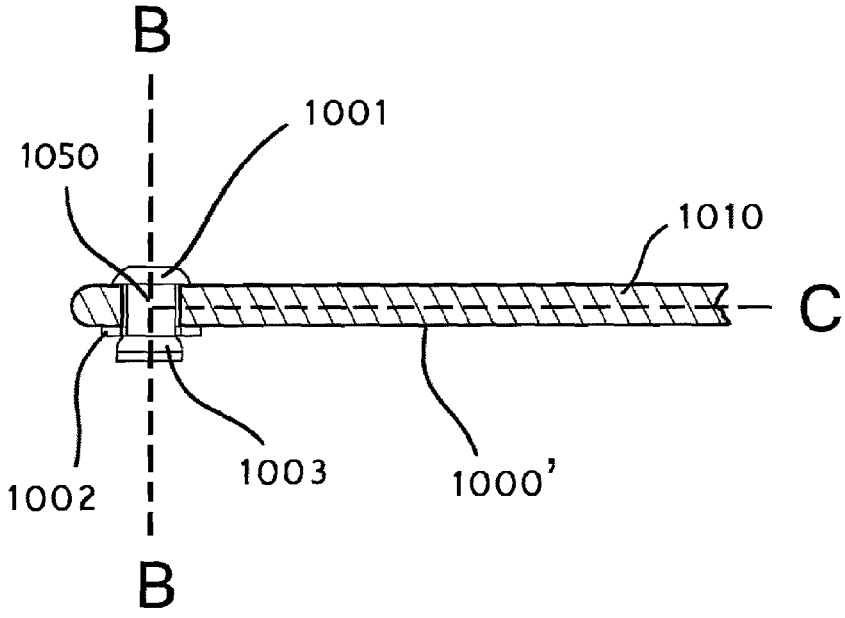
FIG. 20 depicts a cut-away side view of an exemplary rivet fastened in an exemplary strap in an exemplary embodiment of the present invention.

As will be understood by someone with ordinary skill in the art, the exemplary rail opening 619 depicted illustratively in FIGS. 13, 14A-B and 15 would suspend the fastened strap material of the riveted strap 1010 at a substantially, or relatively, perpendicular angle as depicted in FIG. 20 as line "C" with respect to an axis (depicted as line B-B in FIG. 20) of the shaft (illustratively depicted as element 1050 in FIG. 20) of the depicted rivet (depicted in FIGS. 13, 14A-B and 15 as rivet head 1001 and rivet shop head/tail end 1003).

As will be understood by someone with ordinary skill in the art, the rivets would be capable of supporting a shear force (such as is illustratively depicted by exemplary line "C" in FIG. 20) that is exerted perpendicular (substantially or relatively perpendicular) to an axis (depicted as line B-B in FIG. 20) of the shaft 1050 of the rivet, such as may be exerted on a strap 1010 that is secured in a channel (e.g., exemplary channel 603' depicted in FIG. 13; exemplary channel 603" depicted in FIGS. 14A and 14B; and exemplary channel 603 depicted in FIG. 15) by a body of an occupant of the article of furniture. In particular, as was previously mentioned above, there is effectively a head on each end of an installed rivet. Therefore, when a shear load, such as is illustratively depicted by exemplary line "C" in FIG. 20, i.e., that is perpendicular, or substantially or relatively perpendicular, to the axis (depicted as line B-B in FIG. 20) of the shaft 1050 of the rivet is exerted, such as could be caused by the weight of an occupant of the article of furniture against a strap anchored by such rivet in a rail channel rail channel 603 (see FIG. 15), the two heads of the rivet would move toward the opening 619 of the rail channel (e.g., 603 in FIG. 15) until the two heads abut against the opening portions 619 of the rail channel 603 (see FIG. 15) and thereby resist extraction from the opening (see, e.g., element 619' depicted in FIG. 24) between opening portions 619 of the rail channel 603.

As will be further understood by someone with ordinary skill in the art, rail opening 619' (see, e.g., FIG. 18) would be sufficiently large to allow straps 1010 with riveted ends in rail channels, e.g., 603' as depicted in FIG. 18, to snuggly slide into a position in a rail until the strap is contiguous with, or substantially or relatively next to, another strap (as depicted in FIG. 18) or a rail stop (not shown); however, rail opening 619' would be sufficiently small to prevent removal of a rivet-fastened strap end from the channel (e.g., from exemplary channel 603' depicted in FIGS. 13 and 18; exemplary channel 603" depicted in FIGS. 14A and 14B; and exemplary channel 603 depicted in FIG. 15).

As will be further understood by someone with ordinary skill in the art, although the size of the rail opening 619' would be sufficiently large to allow straps 1010 with riveted ends in rail channels, e.g., 603' as depicted in FIG. 18, to snuggly slide into a position in a rail, e.g., until the strap is contiguous with, or substantially or relatively next to, another strap (as depicted in FIG. 18) or a rail stop (not shown); rail opening 619 would be sufficiently small to resist one strap from overriding or overlapping a contiguous or neighboring strap, or otherwise bunching together. Further, exemplary strap assemblies fastened at each respective end with rivets or other fasteners as disclosed herein would tend to resist overriding or overlapping a contiguous or neighboring strap. Further, in an exemplary embodiment of exemplary strap assemblies fastened, such as each end, to exemplary continuous strips as further described below with respect to, e.g., FIGS. 21-26, such exemplary continuous strips may comprise and, depending on the material of which such strips are made, may tend to maintain, exemplary spacing intervals (e.g., 2100 depicted in FIGS. 21 and 22).

Figure 16:
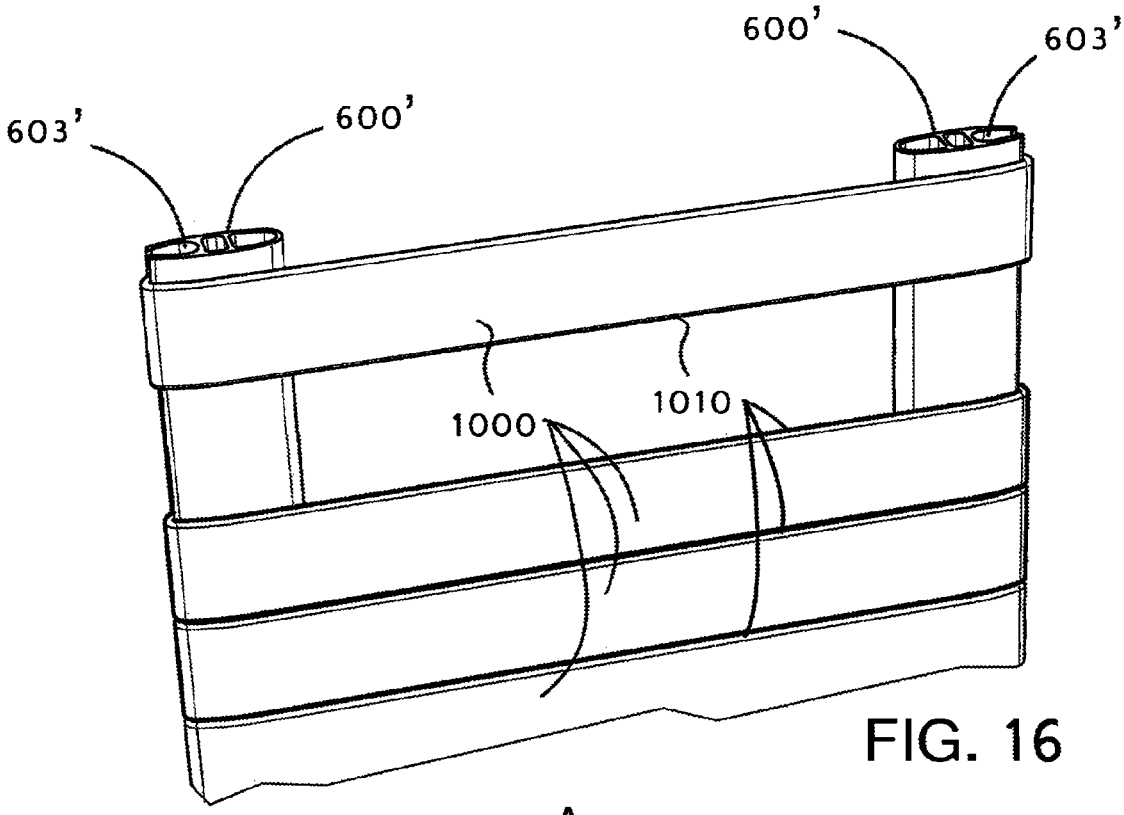
FIG. 16 depicts an exemplary strap that has been inserted into two opposing exemplary exterior side channel rails in an exemplary embodiment of the present invention.
Figure 17:
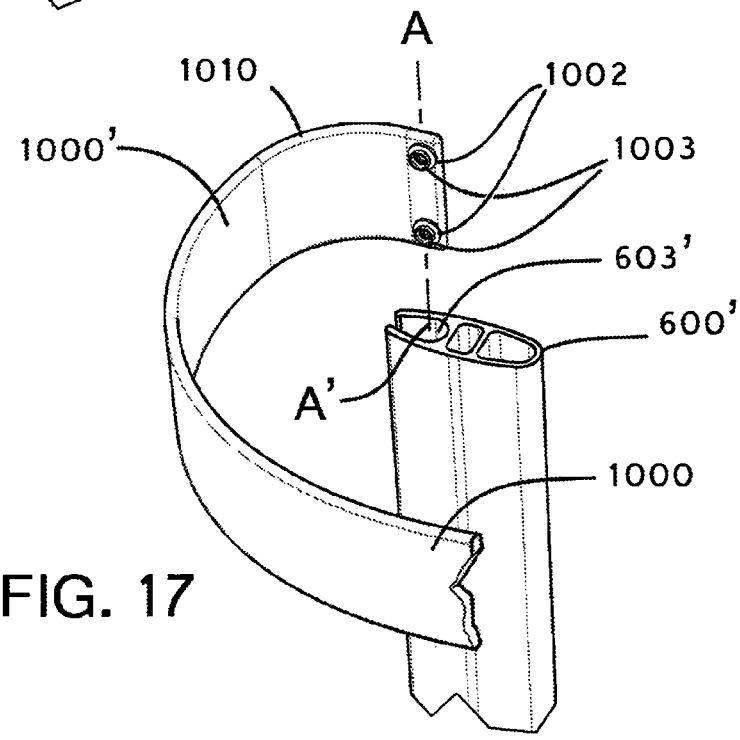
FIG. 17 depicts a perspective view of an exemplary riveted end of a strap positioned for insertion along line A-A' into exemplary exterior side channel in exemplary exterior side channel rail in an exemplary embodiment of the present invention.

FIG. 17 depicts a perspective view of an exemplary riveted end of a strap 1010 positioned for insertion along line A-A' into exemplary exterior side channel 603' in exemplary exterior side channel rail 600'. FIG. 16 depicts an exemplary strap 1010 that has been inserted into two opposing exemplary exterior side channel rails 600'.

As will be understood by someone with ordinary skill in the art, the application of rivets and washers to straps as disclosed herein is a simple function that could be done by someone with limited skills and experience using inexpensive tools. In the event that an expensive sling chair is damaged, the sling element of the chair could be removed, and high-quality straps with rivets attached according to the present invention could be inserted into the existing sling rails. Accordingly, as will be understood by someone with ordinary skill in the art, sling chairs could be retrofitted as strap chairs.

As will further be understood by someone with ordinary skill in the art, as illustratively depicted in the various figures of the present application, straps with rivets attached according to exemplary embodiments of the present invention could be used to convert or retrofit a sling chair to a strap chair, regardless of the channel location (front, exterior side, inner side, rear or some offset variation) in the rails of the sling chair.

Further, as was previously mentioned above, sling chair rails often comprise a corner or radius at a point where the rail that supports the back of the article of furniture transitions into the rail that supports the seat portion of the article of furniture. An exemplary back-to-seat transition curved "radius" is depicted in FIG. 18. As depicted in FIG. 18, end of straps with rivets attached according to exemplary embodiments of the present invention would be flexible so that the ends of such straps could be slid through a channel, e.g. 603', around such a back-to-seat transition curved "radius" so that the subject strap could be slid into a position either in the seat portion of the article of furniture, or could be maintained at the radius.

As will be understood by someone with ordinary skill in the art, rivets or other fasteners, and washers, of various sizes could be used without departing from the spirit of the present invention.

Further, as will be understood by someone with ordinary skill in the art, exemplary chair rails and chair rail channel configurations have been illustrated herewith, but are not a limitation of the present invention. Other chair rail configurations and/or chair rail channel configurations could be used without departing from the spirit of the present invention; the combination of the size of the strap, rivet and washer (or other end fasteners and/or strips and/or clips) would need to fit in the channel in the rail of the article of furniture to be made and/or repaired and/or converted or retrofit, but would need to be of sufficient size that the combination of the strap end, rivets and washers (or other end fasteners and/or strips and/or clips) would be able to be slid through the rail channel; the channel opening 619, e.g., as depicted in FIGS. 13, 14A-B and 15, would need to be sufficiently large to allow a snug sliding of the strap 1010 and would need to be sufficiently small to resist extraction of the riveted (or otherwise fastened) end of the strap through the channel opening 619.

Yet further, as will be understood by someone with ordinary skill in the art, exemplary embodiments of the present invention could use various widths of straps, various colors of straps and/or various materials of straps for a single chair.

FACSIMILE REPRODUCTION OF COPYRIGHT MATERIAL

A portion of the disclosure of this patent document contains material which is subject to copyright protection by the copyright owner, John W. Caldwell and/or his successors and assigns. The copyright owner has no objection to the facsimile reproduction by anyone of the patent document or the patent disclosure, as it appears in the Patent and Trademark Office patent file or records, but otherwise reserves all copyright rights whatsoever.

Illustrative Embodiments

Although this invention has been described in certain specific embodiments, many additional modifications and variations would be apparent to those skilled in the art. It is, therefore, to be understood that this invention may be practiced otherwise than as specifically described. Moreover, to those skilled in the various arts, the invention itself herein will suggest solutions to other tasks and adaptations for other applications. Thus, the embodiments of the invention described herein should be considered in all respects as illustrative and not restrictive, the scope of the invention to be determined by the appended claims and their equivalents rather than the foregoing description.

What is claimed is:

1. A method of web-strapping upholstery of an article of furniture, said method comprising:

fastening a first fastener into a first corner portion of a first end of a first strap, said first fastener comprising a head portion attached at a head end of a first fastener shaft portion, said first fastener shaft portion comprising a first distal end, said first fastener further comprising a first distal end securing portion, said fastening the first fastener comprising inserting said first fastener shaft portion through an opening in said first corner portion of said first end of said first strap, and fastening said first distal end securing portion on said first distal end against the bottom surface of said first strap, securing said first distal end of said first fastener from extraction from said first strap;

fastening a second fastener into a second corner portion of said first end of said first strap, said second fastener comprising a head portion attached at a head end of a second fastener shaft portion, said second fastener shaft portion comprising a second distal end, said second fastener further comprising a second distal end securing portion, said fastening the second fastener comprising inserting said second fastener shaft portion through an opening in said second corner portion of said first end of said first strap, and fastening said second distal end securing portion on said second distal end against the bottom surface of said first strap, securing said second distal end of said second fastener from extraction from said first strap;

fastening a third fastener into a first corner portion of a second end of said first strap, said third fastener comprising a head portion attached at a head end of a third fastener shaft portion, said third fastener shaft portion comprising a third distal end, said third fastener further comprising a third distal end securing portion, said fastening the third fastener comprising inserting said third fastener shaft portion through an opening in said first corner portion of said second end of said first strap, and fastening said third distal end securing portion on said third distal end against the bottom surface of said first strap, securing said third distal end of said third fastener from extraction from said first strap;

fastening a fourth fastener into a second corner portion of said second end of said first strap, said fourth fastener comprising a head portion attached at a head end of a fourth fastener shaft portion, said fourth fastener shaft portion comprising a fourth distal end, said fourth fastener further comprising a fourth distal end securing portion, said fastening the fourth fastener comprising inserting said fourth fastener shaft portion through an opening in said second corner portion of said second end of said first strap, and fastening said fourth distal end securing portion on said fourth distal end against the bottom surface of said first strap, securing said fourth distal end of said fourth fastener from extraction from said first strap;

inserting said first end of said first strap into a first channel that traverses a length of a first side rail of said article of furniture, said first channel comprising an opening that traverses the length of the first side rail;

inserting said second end of said first strap into a second channel that traverses a length of a second side rail of said article of furniture, said second channel comprising an opening that traverses the length of said second side rail; and sliding said first and second ends of said first strap through said first and second channels to place said first strap into a position that traverses a space interval between said first and second side rails.

2. The method of claim 1, wherein a first continuous strip is fastened to a first portion of said first strap; and wherein a second continuous strip is fastened to a second portion of said first strap.

3. The method of claim 2, wherein each of said first and second continuous strips comprises a respective first end and a respective tail end, said method further comprising:

inserting said respective first end of said first continuous strip into a channel that traverses a portion of a length of a first side rail of said article of furniture;

inserting said respective first end of said second continuous strip into a channel that traverses a portion of a length of a second side rail of said article of furniture, wherein said second side rail is separated from said first side rail by a space;

sliding said respective first ends of said first and second continuous strips through said respective channels so that said first strap spans said space between said first and second side rails.

4. The method of claim 3, wherein said inserting said respective first ends of said first and second continuous strips into said channels comprises inserting said respective first ends of said first and second continuous strips into a respective installation port formed in each of said channels.

5. The method of claim 1, wherein said first, second, third and fourth fasteners each comprise a head end, and wherein a first continuous strip is fastened in between said head ends of said first and second fasteners and said first strap; and wherein a second continuous strip is fastened in between said head ends of said third and fourth fasteners; wherein each of said first and second continuous strips comprises a respective first end and a respective tail end.

6. The method of claim 5, said method further comprising:

inserting said respective first end of said first continuous strip into a channel that traverses a portion of a length of a first side rail of said article of furniture;

inserting said respective first end of said second continuous strip into a channel that traverses a portion of a length of a second side rail of said article of furniture, wherein said second side rail is separated from said first side rail by a space;

sliding said respective first ends of said first and second continuous strips through said respective channels so that said first strap spans said space between said first and second side rails.

7. A method of web-strapping upholstery of an article of furniture wherein said article of furniture comprises a first side rail and a second side rail, said first side rail comprising a length and a first channel that traverses the length of said first side rail, said first channel comprising a first channel opening that traverses the length of the first side rail, said second side rail comprising a length and a second channel that traverses the length of said second side rail, said second channel comprising a second channel opening that traverses the length of said second side rail, said method comprising:

fastening a first fastener comprising a head end, a shaft, a tail end, and a tail end fastening portion into a first corner portion of a first end of a first strap, said first strap comprising a top surface and a bottom surface;

securing said tail end fastening portion of said first fastener on said tail end of said first fastener against the bottom surface, securing said tail end of said first fastener from extraction from said first strap;

fastening a second fastener comprising a head end, a shaft, a tail end, and a tail end fastening portion into a second corner portion of said first end of said first strap;

securing said tail end fastening portion of said second fastener on said tail end of said second fastener against the bottom surface, securing said tail end of said second fastener from extraction from said first strap;

fastening a third fastener comprising a head end, a shaft, a tail end, and a tail end fastening portion into a first corner portion of a second end of said first strap;

securing said tail end fastening portion of said third fastener on said tail end of said third fastener against the bottom surface, securing said tail end of said third fastener from extraction from said first strap;

fastening a fourth fastener comprising a head end, a shaft, a tail end, and a tail end fastening portion into a second corner portion of said second end of said first strap;

securing said tail end fastening portion of said fourth fastener on said tail end of said fourth fastener against the bottom surface, securing said tail end of said fourth fastener from extraction from said first strap;

inserting said first end of said first strap into said first channel that traverses said length of said first side rail of said article of furniture, said head ends and said tail ends of said first fastener and said second fastener resisting extraction of said first end of said first strap through said first channel opening; and inserting said second end of said first strap into said second channel that traverses said length of said second side rail of said article of furniture, said head ends and said tail ends of said third fastener and said fourth fastener resisting extraction of said second end of said first strap through said second channel opening.

8. The method of claim 7, wherein said bottom surface of said first strap further comprises a bottom surface of respective reinforcing members on opposing ends of said first strap, wherein said tail ends of said first, second, third and fourth fasteners are fastened against a bottom surface of said respective reinforcing members.

9. The method of claim 7, said method further comprising:

sliding said first and second ends of said first strap through said first and second channels to place said first strap into a position that traverses a space interval between said first and second side rails.

10. The method of claim 7, wherein said first and second channel openings comprise respective opposing opening sides that traverse the length of the respective first and second channel openings, and wherein said head ends and said tail ends of said first, second, third and fourth fasteners resist extraction of said first and second ends of said first strap through said first and second channel openings by interfering with said respective opposing opening sides.

11. The method of claim 7, wherein said first channel opening comprises opposing opening sides that traverse the length of the said first channel opening, and wherein said head ends and said tail ends of said first and second fasteners resist extraction of said first end of said first strap through said first channel opening by interfering with said opposing opening sides.

12. A method of web-strapping upholstery of an article of furniture wherein said article of furniture comprises a first side rail and a second side rail, said first side rail comprising a length and a first channel that traverses the length of said first side rail, said first channel comprising a first channel opening that traverses the length of the first side rail, said second side rail comprising a length and a second channel that traverses the length of said second side rail, said second channel comprising a second channel opening that traverses the length of said second side rail, said method comprising:

fastening a first fastener comprising a head end, a shaft, a tail end, and a tail end fastening portion into a first corner portion of a first end of a first strap, said first strap comprising a top surface and a bottom surface;

securing said tail end fastening portion of said first fastener on said tail end of said first fastener against the bottom surface, securing said tail end of said first fastener from extraction from said first strap;

fastening a second fastener comprising a head end, a shaft, a tail end, and a tail end fastening portion into a second corner portion of said first end of said first strap;

securing said tail end fastening portion of said second fastener on said tail end of said second fastener against the bottom surface, securing said tail end of said second fastener from extraction from said first strap;

fastening a third fastener comprising a head end, a shaft, a tail end, and a tail end fastening portion into a first corner portion of a second end of said first strap;

securing said tail end fastening portion of said third fastener on said tail end of said third fastener against the bottom surface, securing said tail end of said third fastener from extraction from said first strap;

fastening a fourth fastener comprising a head end, a shaft, a tail end, and a tail end fastening portion into a second corner portion of said second end of said first strap;

securing said tail end fastening portion of said fourth fastener on said tail end of said fourth fastener against the bottom surface, securing said tail end of said fourth fastener from extraction from said first strap; and sliding said first and second ends of said first strap through said first and second channels to place said first strap into a position that traverses a space interval between said first and second side rails.

13. The method of claim 12, wherein said first and second channel openings comprise respective opposing opening sides that traverse the length of the respective first and second channel openings, and wherein said head ends and said tail ends of said first, second, third and fourth fasteners resist extraction of said first and second ends of said first strap through said first and second channel openings by interfering with said respective opposing opening sides.

14. The method of claim 12, wherein said first channel opening comprises opposing opening sides that traverse the length of the said first channel opening, and wherein said head ends and said tail ends of said first and second fasteners resist extraction of said first end of said first strap through said first channel opening by interfering with said opposing opening sides.

15. The method of claim 12, said method further comprising:

fastening a first portion of a first continuous strip of material to said first end of said first strap; and fastening a first portion of a second continuous strip of material to said second end of said first strap.

16. The method of claim 15, said method further comprising:

fastening a first portion of a second strap to a second portion of said first continuous strip of material; and fastening a second portion of said second strap to a second portion of said second continuous strip of material.

17. The method of claim 16, said method further comprising:

sliding said first and second ends of said first strap further through said first and second channels to place said second strap into a position that traverses the space interval between said first and second side rails.

* * * * *